US011187230B2

(12) United States Patent
Lee et al.

(10) Patent No.: US 11,187,230 B2
(45) Date of Patent: Nov. 30, 2021

(54) SCROLL COMPRESSOR

(71) Applicant: LG ELECTRONICS INC., Seoul (KR)

(72) Inventors: Kangwook Lee, Seoul (KR); Taekyoung Kim, Seoul (KR); Byeongchul Lee, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 519 days.

(21) Appl. No.: 15/949,890

(22) Filed: Apr. 10, 2018

(65) Prior Publication Data

US 2018/0298901 A1 Oct. 18, 2018

(30) Foreign Application Priority Data

Apr. 12, 2017 (KR) ..... 10-2017-0047554

(51) Int. Cl.
*F04C 29/02* (2006.01)
*F04C 18/02* (2006.01)
(Continued)

(52) U.S. Cl.
CPC ..... *F04C 18/0215* (2013.01); *F04C 23/008* (2013.01); *F04C 29/0057* (2013.01);
(Continued)

(58) Field of Classification Search
CPC ..... F04C 15/0088; F04C 29/02–028; F04C 18/0215; F04C 18/02–0238; F04C 29/021; F04C 29/028; F04B 39/02–0292
(Continued)

(56) References Cited

U.S. PATENT DOCUMENTS 4,958,993 A * 9/1990 Fujio ..... F04C 27/005 418/55.3
5,037,278 A * 8/1991 Fujio ..... F04C 18/0215 418/55.2
(Continued)

FOREIGN PATENT DOCUMENTS

CN 105370576 A 3/2016
CN 109072908 A 12/2018
(Continued)

*Primary Examiner* — Devon C Kramer
*Assistant Examiner* — Thomas Fink
(74) *Attorney, Agent, or Firm* — Birch, Stewart, Kolasch & Birch, LLP

(57) ABSTRACT

A scroll compressor having a casing, a drive motor which is held in place within the casing and has an internal flow passage and an external flow passage to pass through, a rotation shaft which is combined with the drive motor for rotation, a frame that is provided under the drive motor and through which the rotation shaft passes for support, a first scroll which is provided under the frame and on whose one flank surface a first wrap is formed, a second scroll which is provided between the frame and the first scroll, on which a second wrap that is engaged with the first wrap is formed, with which the rotation shaft is eccentrically combined and which forms a compression chamber, and a flow passage separation unit which separates a space between the drive motor and the frame into an internal space and an external space is provided.

5 Claims, 16 Drawing Sheets

(51) Int. Cl.
*F04C 29/00* (2006.01)
*F04C 29/12* (2006.01)
*F04C 23/00* (2006.01)

(52) U.S. Cl.
CPC ..... *F04C 29/0078* (2013.01); *F04C 29/0085* (2013.01); *F04C 29/026* (2013.01); *F04C 29/12* (2013.01); *F04C 2240/40* (2013.01)

(58) Field of Classification Search
USPC ..... 417/366, 368, 372, 410.5
See application file for complete search history.

(56) References Cited

U.S. PATENT DOCUMENTS

| | | | | | |
|---|---|---|---|---|---|
| 5,263,822 | A * | 11/1993 | Fujio | F04C 29/025 | 418/55.4 |
| 2006/0067846 | A1* | 3/2006 | Okaichi | F04C 18/3441 | 418/47 |
| 2010/0263404 | A1* | 10/2010 | Shiotani | F04C 29/025 | 62/468 |
| 2016/0040672 | A1* | 2/2016 | Lee | F04C 29/026 | 417/410.5 |
| 2016/0040673 | A1* | 2/2016 | Lee | F04C 29/028 | 418/55.6 |
| 2016/0047378 | A1* | 2/2016 | Choi | F04C 29/12 | 418/55.1 |

FOREIGN PATENT DOCUMENTS

| | | | | |
|---|---|---|---|---|
| CN | 211422902 | U | 9/2020 | |
| EP | 1 956 244 | A3 | 10/2008 | |
| EP | 2 063 122 | A1 | 5/2009 | |
| EP | 2063122 | A1 * | 5/2009 | F04C 29/045 |
| EP | 2995817 | A1 | 3/2016 | |
| GB | 2 394 008 | A | 4/2004 | |
| JP | 10-159779 | A | 6/1998 | |
| JP | 2001-248575 | A | 9/2001 | |
| JP | 2008-64076 | A | 3/2008 | |
| JP | 2009-264175 | A | 11/2009 | |
| JP | 2011-47343 | A | 3/2011 | |
| JP | 2013-137004 | A | 7/2013 | |
| KR | 10-0608663 | B1 | 8/2006 | |
| KR | 10-2016-0017993 | A | 2/2016 | |

* cited by examiner

SCROLL COMPRESSOR

CROSS-REFERENCE TO RELATED APPLICATION

Pursuant to 35 U.S.C. § 119(a), this application claims the benefit of earlier filing date and right of priority to Korean Application No. 10-2017-0047554, filed on Apr. 12, 2017, the contents of which are incorporated by reference herein in its entirety.

BACKGROUND OF THE DISCLOSURE

1. Field of the Disclosure

The present disclosure relates to a scroll compressor, and particularly to a compressor in which a compression unit is positioned under an electric motor.

2. Background of the Disclosure

A scroll compressor is a compressor in which, while an orbiting motion is performed with multiple scrolls being engaged with each other, a compression chamber which includes an absorption chamber, an intermediate pressure chamber, and a discharge chamber are formed between both scrolls. This type of scroll compressor achieves not only a comparatively high compression when compared with other types of compressor, but also a stable torque due to smooth strokes for refrigerant absorption, compression, and discharge. Therefore, the scroll compressor is widely used for refrigerant compression in an air conditioning apparatus and the like. In recent years, scroll compressors have been introduced in which an eccentric load is reduced, resulting in an operating speed of 180 Hz or higher.

The scroll compressors are categorized into low-pressure compressors in which an absorption pipe communicates with an internal space in a case, which serves as a low-pressure portion, and high-pressure compressors in which the absorption pipe communicates directly with a compression chamber. Thus, in the high-pressure compressor, a drive unit is installed in an absorption space that serves as the low-pressure portion, but in the low-pressure compressor, the drive is installed in a discharge space that serves as a high-pressure portion.

These types of scroll compressors are categorized into upper compression types of scroll compressors and lower compression types of scroll compressors according to positions of the drive unit and a compression unit. In the upper compression type of scroll compressor, the compression unit is positioned more upward than the drive unit, but in the lower compression type of scroll compressor, the compressor unit is positioned more downward than the drive unit.

Normally, in compressors that include a high-pressure type of scroll compressor, a discharge pipe is positioned far away from the compression unit in such a manner that oil is separated from a refrigerant in the internal space in the casing. Therefore, in the high-pressure type of scroll compressor that belongs to the upper compression type of scroll compressor, the discharge pipe is positioned between an electric motor and the compression unit, but the high-pressure type of scroll compressor that belongs to the lower compression type of scroll compressor, the discharge pipe is positioned over the electric motor.

Thus, in the upper compression type of scroll compressor, the refrigerant that is discharged from the compression unit flows from an intermediate space between the electric motor and the compression unit toward the discharge pipe, without flowing up to the electric motor. On the other hand, in the lower compression type of scroll compressor, the refrigerant that is discharged from the compression unit passes through the electric motor, and then flows from an oil separation space, which is formed over the electric motor, toward to the discharge pipe.

At this time, oil that is separated from the refrigerant in an upper space that serves as the separation space passes through the electric motor, and then flows into an oil storage space that is formed under the compression unit. The refrigerant that is discharged from the compression unit passes through the electric motor as well and flows toward the oil separation space.

However, in the lower compression type of scroll compressor in the related art, which is described above, a refrigerant discharge path and an oil collection path, as described above, run in opposite directions and thus interferes with each other. Thus, the refrigerant and the oil cause flow passage resistance. Particularly, the oil does not collect into the oil storage space due to the high-pressure refrigerant. This causes an oil shortage within the casing. Thus, frictional loss or abrasion occurs due to the oil shortage on the compression unit.

Furthermore, as in the lower compression type of scroll compressor in the related art, when the refrigerant discharge path and the oil collection path interfere with each other, the oil that is separated from the refrigerant in the internal space in the casing is mixed again with the refrigerant that is discharged and is discharged to the outside of the compressor. Thus, there occurs a problem in that a severe oil shortage within the compressor occurs.

Furthermore, the lower compression type of scroll compressor in the related art, an oil collection flow passage along which the oil that collects between the electric motor and the compression unit flows into the lower space in the casing is sufficiently secured. Thus, the oil stays over the compression unit. This increases a likelihood that the oil that is mixed with the refrigerant will flow into the upper space and will be then discharged to the outside of the compressor. As a result, a severe oil shortage within the compressor occurs.

SUMMARY OF THE DISCLOSURE

Therefore, an aspect of the detailed description is to provide a scroll compressor in which oil that is separated from a refrigerant in an upper space in a casing flows smoothly into a lower space in the casing.

Another aspect of the detailed description is to provide a scroll compressor in which oil that is separated from a refrigerant in an upper space in a casing is prevented in advance from being mixed with a refrigerant that flows from the lower space toward the upper space in the casing.

Still another aspect of the detailed description is to provide a scroll compressor in which oil that collects between an electric motor and a compression unit collects into a lower space in a casing without being mixed with a refrigerant that is discharged from the compression unit.

Furthermore, still another aspect of the detailed description is to provide a scroll compressor in which a refrigerant flow passage and an oil flow passage are reliably separated.

To achieve these and other advantages and in accordance with the purpose of this specification, as embodied and broadly described herein, there is provided a scroll compressor including: a casing which has an internal space; an electric motor which has a stator that is provided in the internal space and is connected to the casing and a rotor that is rotatably provided within the stator; a compression unit which is provided under the electric motor; a rotation shaft which transfers drive force from the electric motor to the compression unit; and a flow passage separation unit that is installed between the electric motor and the compression unit and separates a refrigerant flow passage and an oil flow passage.

In the scroll compressor, the flow passage separation unit may be installed between the electric motor and the compression unit.

Then, in the scroll compressor, the flow passage separation unit may be formed with a first flow passage guide that is combined with the compression unit and a second flow passage guide that extends from the electric motor, and the second flow passage guide may be configured with an insulator that is provided in the electric motor.

Furthermore, according to another aspect of the present invention, there is provided a scroll compressor including: a casing: a drive motor which is held in place within the casing and has an internal flow passage and an external flow passage to pass through in an axis direction; a rotation shaft which is combined with the drive motor for rotation; a frame that is provided under the drive motor and through which the rotation shaft passes for support; a first scroll which is provided under the frame and on whose one flank surface a first wrap is formed; a second scroll which is provided between the frame and the first scroll, on which a second wrap that is engaged with the first wrap is formed, with which the rotation shaft is eccentrically combined in a manner that overlaps the second wrap in a radial direction, and which forms a compression chamber between the second scroll itself and the first scroll, while performing an orbiting motion with respect to the first scroll; and a flow passage separation unit which is formed in the shape of a ring, and separates a space between the drive motor and the frame into an internal space that communicates with the internal flow passage in the drive motor and an external space that communicates with the external flow passage.

In the scroll compressor, the flow passage separation unit may include a flow passage guide that is provided between the internal space and the external space to protrude from at least one of a lower surface of the drive motor and an upper surface of the frame toward to the other one, and a sealing member that is provided to be brought into contact with the flow passage guide.

Then, in the scroll compressor, the flow passage guide may include a first flow passage guide that protrudes from the upper surface of the frame toward the lower surface of the drive motor, and a second flow passage guide that protrudes from the lower surface of the drive motor toward the upper surface of the frame, the first flow passage guide and the second flow passage guide may be formed in such a manner that heights of the first flow passage guide and the second follow passage guide overlap in the axial direction, and the sealing member may be formed on both flank surfaces of the first flow passage guide and the second flow passage guide, which face each other.

Then, in the scroll compressor, the flow passage guide may protrude from the upper surface of the frame toward the lower surface of the drive motor or may protrude from the lower surface of the drive motor toward the upper surface of the frame, and the sealing member may be provided between an upper surface or a lower surface of the flow passage guide and the lower surface of the drive motor or the upper surface of the frame, which is brought into contact with the upper surface or the lower surface of the flow passage guide.

In the scroll compressor, the flow passage separation unit may include at least one or more flow passage guides that are provided between the internal space and the external space to protrude from at least one of a lower surface of the drive motor and an upper surface of the frame toward the other one, and one end of the flow passage separation unit may be inserted into the lower surface of the drive motor or the upper surface of the frame to form a sealing portion.

Then, in the scroll compressor, the flow passage separation unit may include a first flow passage guide that protrudes from an upper surface of the frame toward a lower surface of the drive motor, and a second flow passage guide that protrudes from the lower surface of the drive motor toward the upper surface of the frame, and a sealing portion may be formed as a result of combining a lower surface of the first flow passage guide and an upper surface of the second flow passage guide that faces the lower surface of the first flow passage guide, in an interference engagement manner. That is, at least one of an upper surface of the first flow passage guide and a lower surface of the second flow passage guide may be provided with a protrusion and another one is provided with a groove, and the protrusion and the groove are engaged with each other to form a sealing portion.

Then, in the scroll compressor, the flow passage separation unit may include a first flow passage guide that protrudes from an upper surface of the frame toward a lower surface of the drive motor, and a second flow passage guide that protrudes from the lower surface of the drive motor toward the upper surface of the frame, and a sealing portion may be formed as a result of combining a flank surface of the first flow passage guide and a flank surface of the second flow passage guide that faces the flank surface of the first flow passage guide in a manner that brings the two flank surfaces into contact tightly with each other or in a stair-stepped manner. That is, a flank surface of the first flow guide and a side surface of the second flow guide facing each other are closely adhered to form a sealing portion, or stepped portions are formed respectively on the side surface of the first guide and the side surface of the second guide facing each other so as to form the sealing portion.

Furthermore, to achieve these and other advantages and in accordance with the purpose of this specification, as embodied and broadly described herein, there is provided a scroll compressor including: a casing; a stator which is held in place within the casing, on whose outer circumferential surface at least one or more first gaps that are positioned a distance away from an inner circumferential surface of the casing are formed, and on whose inner circumferential surface a coil winding portion around which a winding coil is wound; a rotor which is rotatably provided to be positioned a second gap away from the inner circumferential surface of the stator; a rotation shaft which is combined with the rotor for concurrent rotation; a frame which is provided under the stator and through which the rotation shaft passes for support; a first scroll which is provided under the frame and on whose one flank surface a first wrap is formed; a second scroll on whose surface that is brought into contact with the frame a sealing member insertion groove is formed, which is provided between the frame and the first scroll, on which a second wrap that is engaged with the first wrap is formed, with which the rotation shaft is eccentrically combined in a manner that overlaps the second wrap in a radial direction, and which forms a compression chamber between the second scroll itself and the first scroll, while performing an orbiting motion with respect to the first scroll; and a flow passage guide that extends from an upper surface of the frame or a lower surface of the stator that faces the upper surface of the frame, in an axial direction and that separates the first gap and the second gap, in which the flow passage guide includes a first annular wall portion that is formed in the shape of a ring and has a height in a first axial direction, which is positioned between the first gap and the coil winding portion, and a second annular wall portion that is formed in the shape of a ring and has a height in a second axial direction, which is positioned between the second gap and the coil winding portion.

In the scroll compressor, the first annular wall portion may further include a sealing member between the first annular wall portion and a member that the first annular wall portion faces.

Then, in the scroll compressor, for combination, the first annular wall portion may be inserted into a member that the first annular wall portion faces.

Then, in the scroll compressor, for combination, the first annular wall portion may be brought into contact tightly with an outer circumferential surface or an inner circumferential surface of a member that the first annular wall portion faces.

Then, in the scroll compressor, the first annular wall portion may be formed to have a greater height than the second annular wall portion, or to have the same height as the second annular wall portion.

Then, in the scroll compressor, a balance weight may be provided on the rotor or the rotation shaft, and the balance weight may be positioned inward from the second annular wall portion.

Then, in the scroll compressor, an end portion of the second annular wall portion may be positioned a distance away in the axial direction from the member that the end portion of the annular wall portion face.

Furthermore, To achieve these and other advantages and in accordance with the purpose of this specification, as embodied and broadly described herein, there is provided a scroll compressor including: an electric motor; a compression unit; a casing which accommodates the electric motor and the compression unit, and that has a first space between the electric motor and the compression unit, a second space over the electric motor, and a third space under the compression unit, and a flow passage guide which is included in the first space and that separates the first space into multiple spaces along the radial direction; and a sealing portion which is provided between the flow passage guide and a member that the flow passage guide face.

In the scroll compressor, the sealing portion may be a sealing member that is inserted between the flow passage guide and the member that the flow passage guide faces.

Then, in the scroll compression, the sealing portion may be formed to be brought into contact tightly with the flow passage guide and a member that the flow passage guide faces.

Then, in the scroll compressor, the flow passage guide may include a first annular wall portion which is formed in the shape of a ring, and which has a first height in an axial direction; a second annular wall portion which is formed in the shape of a ring, has a second height in the axial direction, and which is positioned inward from the first annular wall portion; and an annular surface portion that connects between the first annular wall portion and the first annular wall portion.

Then, in the scroll compressor, a refrigerant hole which guides a refrigerant that is compressed in the compression unit, to the first space may be formed in the compression unit, and a refrigerant through-hole may be formed between the first annular wall portion and the second annular wall portion.

Then, in the scroll compressor, an oil collection groove for collecting oil that flows down on an upper surface of the compression unit may be formed in the upper surface of the compression unit, and the oil collection groove may be formed in such a manner that both spaces that result from separation by the flow passage guide communicate with each other.

A scroll compressor according to the present invention, a refrigerant flow passage and an oil flow passage are separated in such a manner that a refrigerant which is discharged from a compression unit flows into a discharge pipe along the refrigerant flow passage, and that oil which is separated from the refrigerant over an electric motor flows in a lower space along the oil flow passage. Thus, the flow passage along which the refrigerant is discharged and the flow passage along which the oil collects is prevented from interfering with each other and thus the flow of the oil can be prevented from being blocked due to the high-pressure refrigerant. As a result, the oil collects smoothly into the lower space, thereby preventing an oil shortage in advance.

Furthermore, a sealing member or a sealing portion is provided on a flow passage separation unit that separates the refrigerant flow passage and the oil flow passage. A gap is prevented from occurring to the flow passage separation unit. As a result, the refrigerant flow passage and the oil flow passage are tightly separated, thereby minimizing a decrease in oil collection due to the refrigerant.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

A scroll compressor according to an embodiment of the present invention will be described in detail below with reference to the accompanying drawing. For reference, the scroll compressor according to the present invention relates to a structure for increasing the sealing property and the durability of a sealing member that is installed between an orbiting scroll and a frame that corresponds to the orbiting scroll and that forms a backpressure chamber. Therefore, the sealing member between the orbiting scroll and a member that is brought into contact with the orbiting scroll finds application in any type of scroll compressor. For convenience, as a typical example, a type of scroll compressor in which a rotation shaft overlaps a volute wrap in the same plane will be described, among lower compression types of scroll compressors in which a compression unit is positioned more downward than an electric motor. It is known that this type of scroll compressor is suitable for application in a freezing cycle under the condition of a high pressure ratio at high-temperature.

Figure 1:
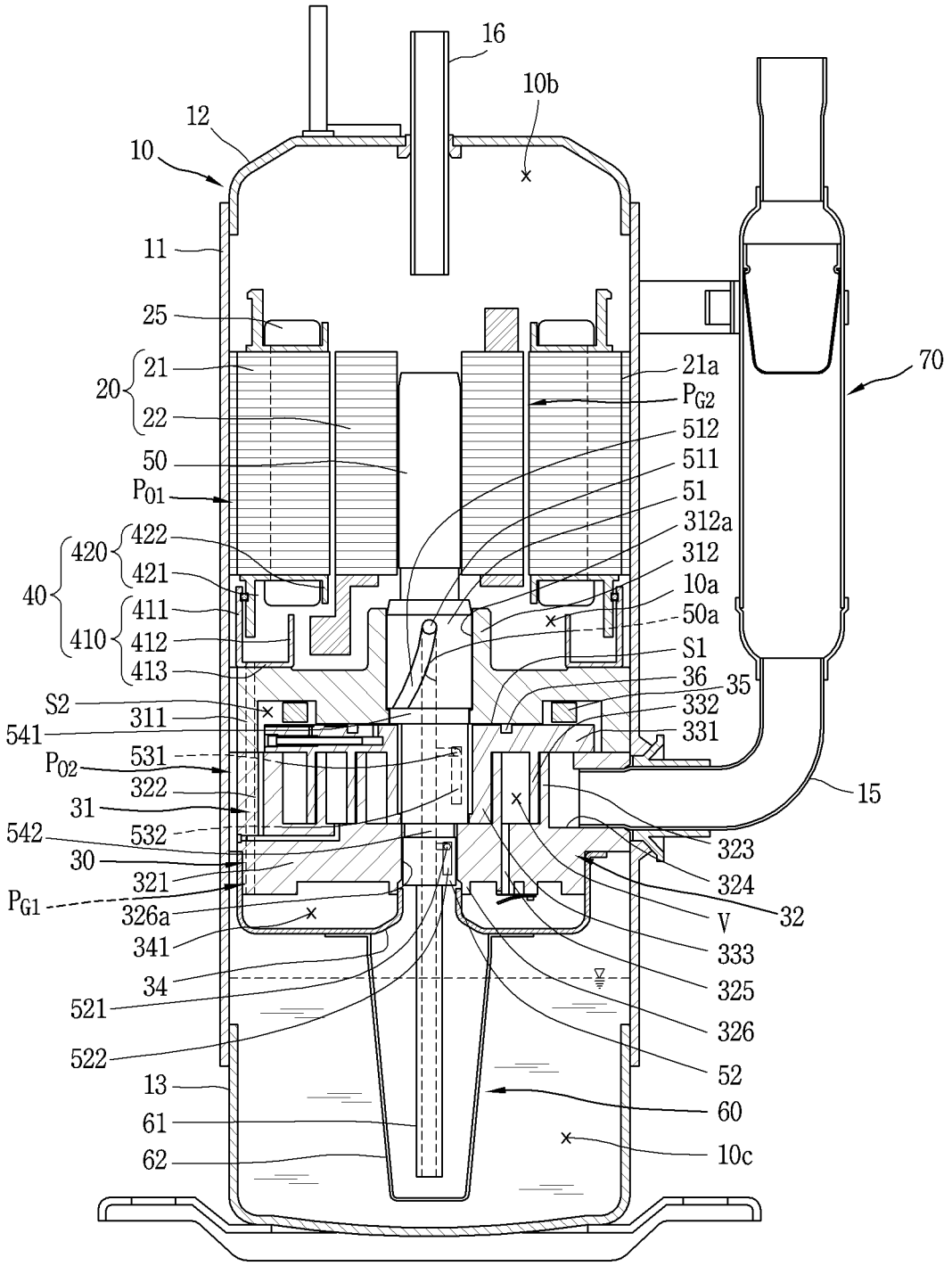
FIG. 1 is a vertical cross-sectional diagram illustrating a lower compression type of scroll compressor according to the present invention.
Figure 2:
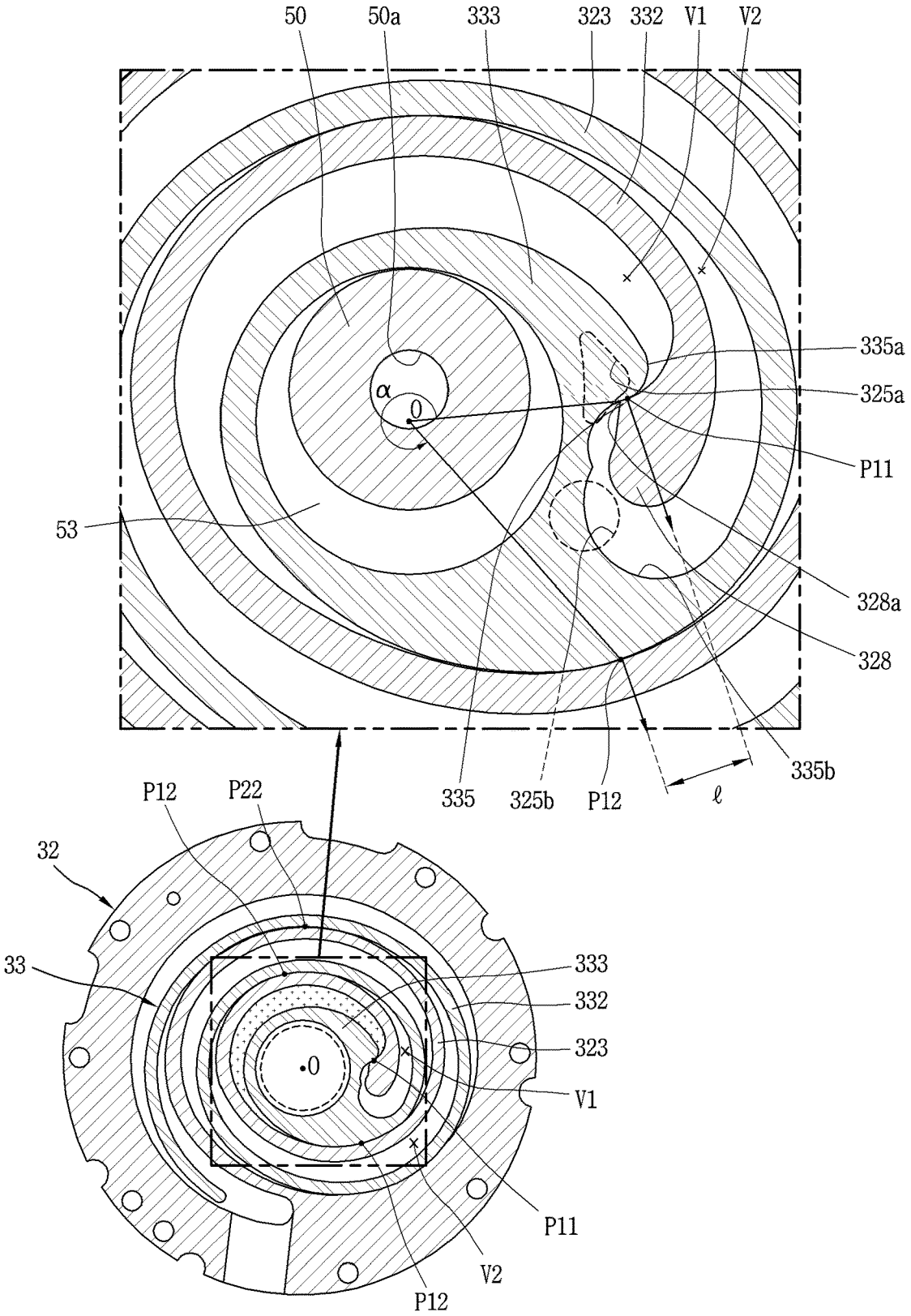
FIG. 2 is a horizontal cross-sectional diagram illustrating a compression unit in FIG. 1.
Figure 3:
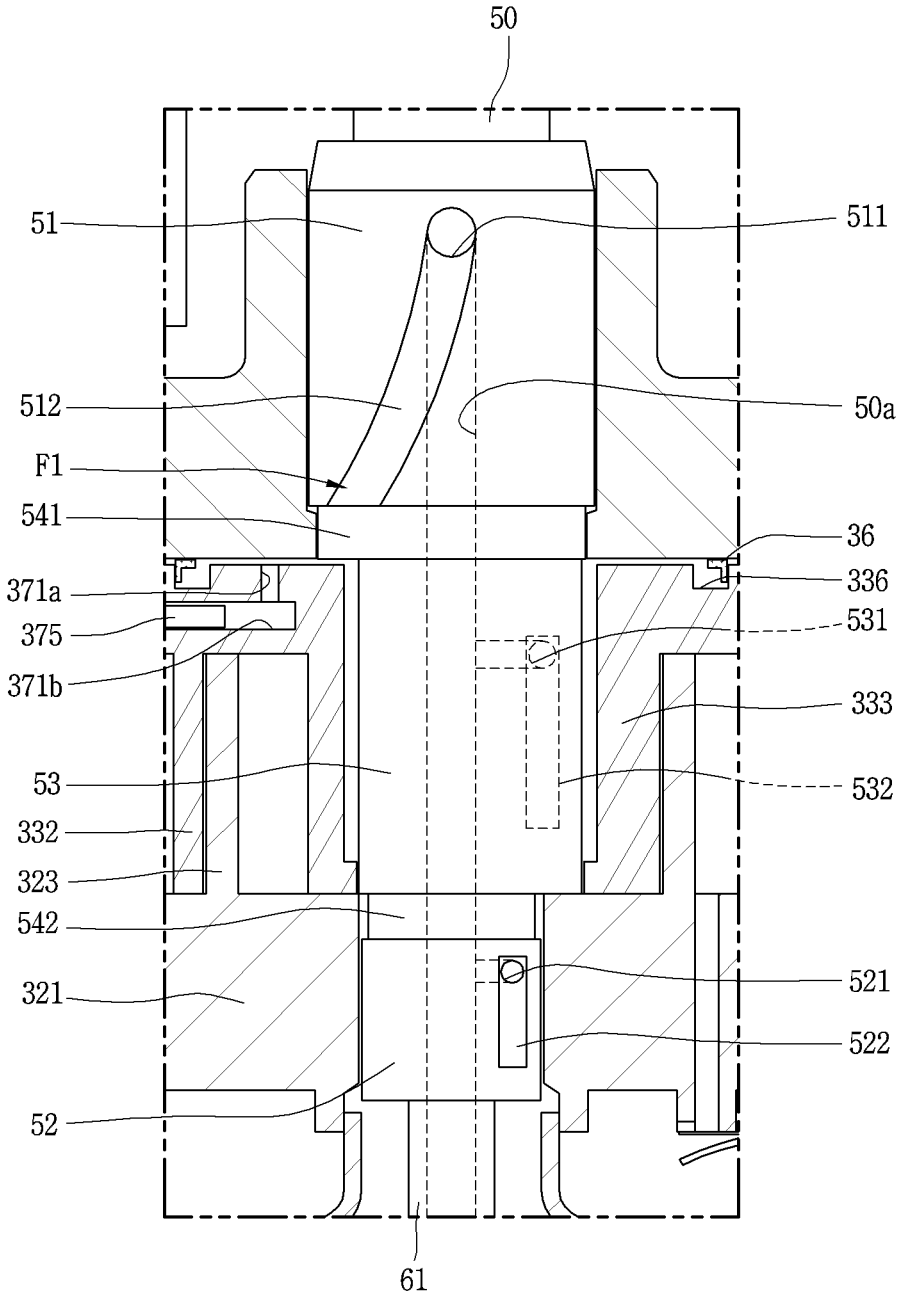
FIG. 3 is a front-view diagram illustrating a portion of a rotation shaft for describing a sliding member in FIG. 1.
Figure 4:
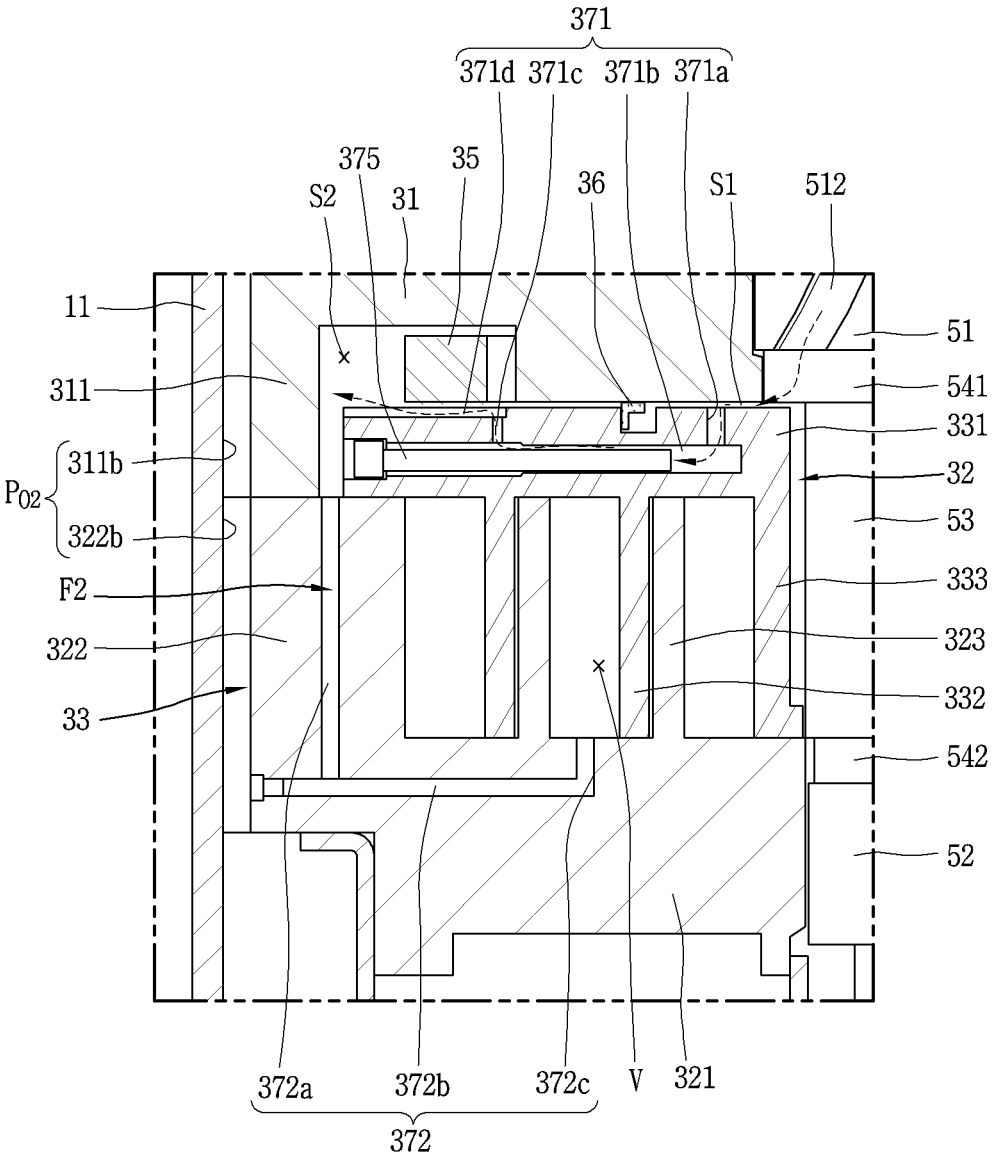
FIG. 4 is a vertical cross-sectional diagram for describing an oil supply path between a backpressure chamber and a compression chamber in FIG. 1.

FIG. 1 is a vertical cross-sectional diagram illustrating a lower compression type of scroll compressor according to the present invention. FIG. 2 is a horizontal cross-sectional diagram for describing a sliding member in FIG. 1, illustrating a compression unit in FIG. 1. FIG. 3 is a front-view diagram illustrating a portion of a rotation shaft. FIG. 4 is a vertical cross-sectional diagram for describing an oil supply path between a backpressure chamber and a compression chamber.

With reference to FIG. 1, a lower compression type of scroll compressor according to the present embodiment includes an electric motor 20 and a compression unit 30 within a casing 10. The electric motor 20 serves as a drive motor and generates rotary force. The compression unit 30 is installed under the electric motor 20 between a prescribed space (hereinafter referred to as an intermediate space) 10*a*. The compression unit 30 is provided with the rotary force of the electric motor 20 and compresses a refrigerant.

The casing 10 is configured to include a cylindrical shell 11 that makes up a sealed receptacle, an upper shell 12 that covers an upper portion of the cylindrical shell 11 to make up the sealed receptacle along with the cylindrical shell 11, and a lower shell 13 that makes up the sealed receptacle along with the cylindrical shell 11 and, at the same time, forms an oil storage space 10*c*.

A refrigerant absorption pipe 15 passes through a flank surface of the cylindrical shell 11 and communicates directly with an absorption chamber of the compression unit 30. A refrigerant discharge pipe 16 that communicates with an upper space 10*b* in the casing 10 is installed in an upper portion of the upper shell 12. The refrigerant discharge pipe 16A corresponds to a path along which a compressed refrigerant that is discharged from the compression unit 30 to the upper space 10*b* in the casing 10 is exhausted to the outside. The refrigerant discharge pipe 16 is inserted into up to the middle of the upper space 10*b* in the casing 10 in such a manner that a type of oil separation space is formed in the upper space 10*b*. Then, whenever necessary, an oil separator (not illustrated) that separates oil from an oil-mixed refrigerant may be installed within the casing 10 including the upper space 10*b*, or within the upper space 10*b*, in a manner that is connected to the refrigerant absorption pipe 15.

Teeth and slots that make up multiple coil winding portions (each of which has a reference numeral) are formed along a circumferential direction on an inner circumferential surface of a stator 21, and a coil 25 is wound around the stator 21. A second refrigerant flow passage PG2 is formed that results from combining a gap between the inner circumferential surface of the stator 21 and an outer circumferential surface of a rotor 22 and the coil winding portions. Accordingly, the refrigerant, which is discharged to the intermediate space 10*c* between the electric motor 20 and the compression unit 30 through a first refrigerant flow passage PG1 that will be described above, moves to the upper space 10*b* that is formed above the electric motor 20, through the second refrigerant flow passage PG2 that is formed in the electric motor 20.

Then, multiple D-cut surfaces are formed along the circumferential direction on an outer circumferential surface of the stator 21. A first oil flow passage PO1 is formed on the D-cut surface 21*a* in such a manner that oil passes between the D-cut surface 21*a* itself and an inner circumferential surface of the cylindrical shell 11. Accordingly, the oil, which is separated from the refrigerant, moves to a lower space 10*c* through the first oil flow passage PO1 and through a second oil flow passage PO2 that will be described below.

A frame 31, which serves as the compression unit 30 with a prescribed gap between the frame 31 itself and the stator 21, is combined fixedly with the inner circumferential surface of the casing 10 under the stator 21. The frame 31 is fixedly combined with the inner circumferential surface of the cylindrical shell 11 using a shrink fitting method or a welding manner.

Then, a frame side-wall portion (a first side-wall portion) 311 that takes the shape of a ring is formed on an edge of the frame 31. Multiple communicating grooves 311*b* are formed along the circumferential direction in an outer circumferential surface of the first side-wall portion 311. The communicating groove 311*b*, along with a communicating groove 322*b* in a first scroll 32 that will be described above, forms the second oil flow passage PO2.

Furthermore, a first shaft bearing unit 312 for supporting a main bearing unit 51 of a rotation shaft 50 that will be described below is formed on the center of the frame 31. A first shaft bearing hole 312*a*, into which the main bearing unit 51 of the rotation shaft 50 is rotatably inserted for support in a radial direction, is formed in the first shaft bearing unit 312 to pass through the first shaft bearing unit 312 in an axial direction.

Then, a stationary scroll (hereinafter referred to as a first scroll) 32 is installed on a lower surface of the frame 31 with the lower surface itself of the frame 31 and an orbiting scroll (hereinafter referred to as a second scroll) 33 eccentrically combined with the rotation shaft 50 in between. The first scroll 32 may be combined with the frame 31 in a fixed manner, or may be combined with the frame 31 in a manner that is movable in the axial direction.

On the other hand, on the first scroll 32, a stationary disc portion (hereinafter referred to as a first disc portion) 321 is formed in approximately the shape of a circle. A scroll side-wall portion (hereinafter referred to as a second side-wall portion) 322, which is combined with an edge of a lower surface of the frame 31, is formed on an edge of the first disc portion 321.

An absorption inlet 324, through which the refrigerant absorption pipe 15 and the absorption chamber communicate with each other, is formed one side of the second side-wall portion 322 to pass through the one side of the second side-wall portion 322. Discharge outlets 325*a* and 325*b*, which communicate with a discharge chamber and through which the compressed refrigerant is discharged, are formed in a center portion of the first disc portion 321. One discharge outlet 325*a* or 325*b* may be formed in such a manner as to communicate with both a first compression chamber V1 and a second compression chamber V2, which will be described below, and multiple discharge outlets, that is, the discharge outlets 325*a* and 325*b* may be formed independently in such a manner as to communicate with the compression chambers V1 and V2, respectively.

Then, the communicating groove 322*b*, which is described above, is formed in an outer circumferential surface in the second side-wall portion 322. The communicating groove 322*b*, along with the communicating groove 311*b* in the first side-wall portion 311, forms the second oil flow passage PO2 for guiding oil that is collected, to the lower space 10*c*.

Furthermore, a discharge cover 34 for guiding a refrigerant that is discharged from the compression chamber V, to a refrigerant flow passage, which will be described below, is combined with a lower side of the first scroll 32. An internal space in the discharge cover 34 is formed in such a manner as to accommodate the discharge outlets 325*a* and 325*b*, and, at the same time, in such a manner as to accommodate an entrance to the first refrigerant flow passage PG1 that guides the refrigerant that is discharged from the compression chamber V through the discharge outlet 325 *a* or 325*b*, to the upper space 10*b* in the casing 10, more precisely, to a space between the electric motor 20 and the compression unit 30.

At this point, the first refrigerant flow passage PG1 is formed to pass through the second side-wall portion 322 of the stationary scroll 32 and the first side-wall portion 311 of the frame 31, sequentially, starting from inside of a flow passage separation unit 40, that is, from the rotation shaft 50 that is positioned inward from the flow passage separation unit 40. Accordingly, the second oil flow passage PO2, which is described above, is formed outside of the flow passage separation unit 40 in such a manner as to communicate with the first oil flow passage PO1. The oil separation unit will be described in detail below.

A stationary wrap (hereinafter referred to as a first wrap) 323 is formed on an upper surface of the first disc portion 321. The stationary wrap intermeshes with an orbiting wrap (hereinafter referred to as a second wrap) 332, which will be described below, and thus makes up the compression chamber V. The first wrap 323 will be described below along with the second wrap 332.

Furthermore, a second shaft bearing unit 326, which supports a sub-bearing unit 52 of the rotation shaft 50, which will be described below, is formed on the center of the first disc portion 321. A second shaft bearing hole 326*a*, through which the sub-bearing unit 52 passes in the axial direction to be supported in the radial direction, is formed in the second shaft bearing unit 326.

On the other hand, an orbiting disc portion (hereinafter referred to as a second disc portion) 331 of the second scroll 33 is formed approximately in the shape of a disk. The second wrap 332, which intermeshes with the first wrap 322 and thus makes up the compression chamber, is formed on a lower surface of the second disc portion 331.

Along with the first wrap 323, the second wrap 332 may be formed in an involute shape, and may be formed in various shapes other than the involute shape. For example, as illustrated in FIG. 2, the second wrap 332 may take a shape in which multiple circular arcs that have different diameters and origins are connected to each other, and the outermost curved line is formed in the shape of approximately an ellipse that has a long axis and a short axis. The first wrap 323 may be formed in the same manner.

A rotation shaft combination portion 333, into which an eccentricity portion 53 of the rotation shaft 50 is rotatably inserted for combination, is formed in a center portion of the second disc portion 331 to pass through the center portion of the second disc portion 331 in the axial direction. The rotation shaft combination portion 333 is an internal end portion of the second wrap 332. The eccentricity portion 53 of the rotation shaft 50 will be described below.

An outer circumferential portion of the rotation shaft combination portion 333 is connected to the second wrap 332 and plays the role of forming the compression chamber V along with the first wrap 322 during a compression process.

Furthermore, the rotation shaft combination portion 333 is formed to such a height that rotation shaft combination portion 333 overlaps the second wrap 332 in the same plane, and thus the eccentricity portion 53 of the rotation shaft 50 is positioned at such a height that the eccentricity portion 53 overlaps the second wrap 332 in the same plane. When this is done, counterforce by the refrigerant and compression force against the refrigerant are applied to the same plane with respect to the second disc portion 331, and thus cancel each other out. As a result, the second scroll 33 can be prevented from being inclined due to the exertion of compression force and counterforce.

Furthermore, a recessed portion 335 that is engaged with a protruding portion 328 of the first wrap 323, which will be described below, is formed the outer circumferential portion of the rotation shaft combination portion 333 that faces an internal end portion of the first wrap 323. An increment portion 335*a* is formed on one side of the recessed portion 335. A thickness of the increment portion 335 increases over portions of the rotation shaft combination portion 333, starting with an inner circumferential portion thereof, ending with the outer circumferential portion thereof, upstream along a direction of forming the compression chamber V. This increases a compression path in the first compression chamber V1 immediately before discharge, and consequently, a compression ratio in the first compression chamber V1 is increased closely to a compression ratio in the second compression chamber V2. The first compression chamber V1, which is a compression chamber that is formed between an internal flank surface of the first wrap 323 and an external flank surface of the second wrap 332, will be described below separately from the second compression chamber V2.

A circular-arc compression surface 335*b* that takes the shape of a circular arc is formed on the other side of the recessed portion 335. A diameter of the circular-arc compression surface 335*b* is determined by an internal end portion thickness (that is, a thickness of a discharge end) of the first wrap 323 and an orbiting radius of the second wrap 332. When the internal end portion thickness of the first wrap 323 is increased, the diameter of the circular-arc compression surface 335*b* is increased. As a result, a thickness of the second wrap in the vicinity of the circular-arc compression surface 335*b* is increased, and the compression path is lengthened. The compression ratio in the second wrap V2 is increased as much as the compression path is lengthened.

Furthermore, the protruding portion 328, which protrudes from the outer circumferential portion side of the rotation shaft combination portion 333, is formed in the vicinity of an internal end portion (an absorption end or a start end) of the first wrap 323, which corresponds to the rotation shaft combination portion 333. A contact portion 328*a*, which protrudes from the protruding portion 328 and is engaged with the recessed portion 335, is formed on the protruding portion 328. That is, the internal end portion of the first wrap 323 is formed in such a manner that the internal end portion has a greater thickness than other portions. As a result, wrap strength of the internal end portion of the first warp 323, on which the largest compression force is exerted is improved, thereby increasing the durability.

On the other hand, the compression chamber V is formed between the first disc portion 321 and the first wrap 323, and between the second wrap 332 and the second disc portion 331, and is configured to include an absorption chamber, an intermediate pressure chamber, and a discharge chamber that are successively formed along a direction in which a wrap progresses.

As illustrated in FIG. 2, the compression chamber V is configured to include the first compression chamber V1 that is formed between the internal flank surface of the first wrap 323 and the external flank surface of the second wrap 332, and the second compression chamber V2 that is formed between an external flank surface of the first wrap 323 and an internal flank surface of the second wrap 332.

That is, the first compression chamber V1 includes a compression chamber that is formed between two contact points P11 and P12 which occur when the internal flank surface of the first wrap 323 and the external flank surface of the second wrap 332 are brought into contact with each other. The second compression chamber V2 includes a chamber that is formed between two contact points P21 and P22 which occur when the external flank surface of the first warp 323 and the internal flank surface of the second wrap 332 are brought into contact with each other.

At this point, when the greater of angles that the two contact points P11 and P12 that connect the center of the eccentricity portion 53, that is, the center O of the rotation shaft combination portion 333 and the two contact points P11 and P12, respectively, make with respect to each other is defined as having a value of $\alpha$, $\alpha<360°$ at least immediately before discharge start, and a distance I between normal vectors at the two contact points P11 and P12 has a value of 0 or greater.

For this reason, the first compression chamber immediately before the discharge has a smaller volume than is the case when the stationary wrap and the orbiting wrap that take the shape of an involute curve, and thus the compression ratio in the compression chamber V1 and the compression ratio in the compression chamber V2 are both improved without increasing sizes of the first wrap 323 and the second wrap 332.

On the other hand, as described above, the second scroll 33 is installed, in a manner that enables the second scroll 33 to orbit, between the frame 31 and the stationary scroll 32. Then, an oldham ring 35 that prevents the second scroll 33 from rotating about its axis is installed between an upper surface of the second scroll 33 and a lower surface of the frame 31 that corresponds to the upper surface of the second scroll 33. A sealing member 36, which forms a backpressure chamber S1 that will be described below, is installed more inward than the oldham ring 35.

Then, as a result of an oil supply hole 321*a* that is provided in the second scroll 32, an intermediate pressure space is formed outside of the sealing member 36. The intermediate pressure space communicates with the compression chamber V and, when filled with an intermediate-pressure refrigerant, plays the role of the backpressure chamber. Accordingly, the counterpressure chamber that is formed more inward than the sealing member 36 is defined as a backpressure chamber S1, the counterpressure chamber that is formed more outward than the sealing member 36 is defined as a second backpressure chamber S2. Consequently, the backpressure chamber S1 is a space that is formed by a lower surface the frame 31 and an upper surface of the second scroll 33 with the sealing member 36 in between. The backpressure chamber S1 will be again described below along with the sealing member.

On the other hand, an upper portion of the rotation shaft 50 is pressure-inserted into the center of the rotor 22 for combination and a lower portion thereof is combined with the compression unit 30 for support in the radial direction. Accordingly, the rotation shaft 50 transfers the rotary power of the electric motor 20 to the orbiting scroll 33 of the compression unit 30. Then, the second scroll 33 that is eccentrically as combined with the rotation shaft 50 performs an orbiting motion with respect to the first scroll 32.

The main bearing unit (hereinafter referred to as the first bearing unit) 51, which is inserted into the first shaft bearing hole 312*a* in the frame 31 for support in the radial direction, is formed on a lower half portion of the rotation shaft 50. The sub-bearing unit 52 (hereinafter referred to as the second bearing unit) 52, which is inserted into the second shaft bearing hole 326*a* in the first scroll 32 for support in the radial direction, is formed under the first bearing unit 51. Then, the eccentricity portion 53, which is inserted into the rotation shaft combination portion 333 for combination, is formed between the first bearing unit 51 and the second bearing unit 52.

The first bearing unit 51 and the second bearing unit 52 is formed on the same axial line, in such a manner as to have the same axial center. The eccentricity portion 53 is essentially formed in the radial direction with respect to the first bearing unit 51 or the second bearing unit 52. The second bearing unit 52 may be eccentrically formed with respect to the first bearing unit 51.

In a case where an outside diameter of the eccentricity portion 53 is formed to be smaller than an outside diameter of the first bearing unit 51, but to be greater than an outside diameter of the second bearing unit 52, is advantageous in that the rotation shaft 50 passes the shaft bearing holes 312*a* and 326*a* and the rotation shaft combination portion 333 for combination. However, in a case where the eccentricity portion 53 is formed using a separate bearing, without being integrally with the rotation shaft 50, the rotation shaft 50 is inserted for combination even if the outside diameter of the second bearing unit 52 is formed to be smaller than the outside diameter of the eccentricity portion 53.

Then, an oil supply flow passage 50*a* for supplying oil to each bearing unit and the eccentricity portion is formed, along the axial direction, inside of the rotation shaft 50. The compression unit 30 is positioned more downward than the electric motor 20, and thus the oil supply flow passage 50*a* is formed, by grooving, to a height from a lower end of the rotation shaft 50 to approximately a lower end of the stator 21, to the middle of the height, or to a position that is higher than an upper end of the first bearing unit 51. Of course, when necessary, the oil supply path 50*a* may be formed to pass through the rotation shaft 50 in the axial direction.

Then, an oil feeder 60 for pumping the oil with which the lower space 10*c* is combined with the lower end of the rotation shaft 50, that is, a lower end of the second bearing unit 52. The oil feeder 60 is configured to include an oil supply pipe 61 that is inserted into the oil supply flow passage 50*a* in the rotation shaft 50 for combination, and a blocking member 62 that accommodate the oil supply pipe 61 and block introduction of a foreign material. The oil supply pipe 61 is positioned to pass through the discharge cover 34 and to be immersed in the oil in the lower space 10*c*.

On the other hand, as illustrated in FIG. 3, a sliding member oil supply path F1 for supplying oil to each sliding member, which is connected to the oil supply flow passage 50*a*, is formed in each bearing unit 51 or 52 of the rotation shaft 50 and the eccentricity portion 53.

The sliding member oil supply path F1 is configured to include a plurality of oil supply holes, that is, oil supply holes 511, 521, and 531 to pass through in the oil supply flow passage 50*a* toward an outer circumferential surface of the rotation shaft 50, and a plurality of oil supply grooves, that is, oil supply grooves 512, 522, and 532 in the bearing units 51 and 52 and an outer circumferential surface of the eccentricity portion 53, which communicate with the oil supply holes 511, 521, and 531, respectively, for lubricating the bearing units 51 and 52 and the eccentricity portion 53 with oil.

For example, the first oil supply hole 511 and the first oil supply groove 512 are formed in the first bearing unit 51, the second oil supply hole 521 and the second oil supply groove 522 are formed in the second bearing unit 52, and the third oil supply hole 531 and the third oil supply groove 532 are formed in the eccentricity portion 53. The first oil supply groove 512, the second oil supply groove 522, and the third oil supply groove 532 each are formed in the shape of a longitudinal groove that runs lengthwise in the axial direction or in an inclination direction.

Then, a first connection groove 541 and a second connection groove 542 are formed between the first bearing unit 51 and the eccentricity portion 53, and the eccentricity portion 53 and the second bearing unit 52, respectively. A lower end of the first oil supply groove 512 communicates with the first connection groove 541, and an upper end of the second oil supply groove 522 communicates with the second connection groove 542. Thus, a portion of the amount of oil with which the first bearing unit 51 is lubricated along the first oil supply groove 512 flows along the first connection groove 541, and collects. This oil is in turn introduced into the first backpressure chamber S1 and forms backpressure of discharge pressure. Furthermore, oil with which the second bearing unit 52 is lubricated along the second oil supply groove 522, and oil with which the eccentricity portion 53 is lubricated along the third oil supply groove 532 collects on the second connection groove 542. This oil in turn passes between a front surface of the rotation shaft combination portion 333 and the first disc portion 321 and is introduced into the compression unit 30.

Then, a small amount of oil that is absorbed upward above the first bearing unit 51 flows out from an upper end of the first shaft bearing unit 312 of the frame 31 to outside of the bearing surface, then flows over the first shaft bearing unit 312 down to an upper surface 31*a* of the frame 31, and lastly flows over the oil flow passages PO1 and PO2, which are successively formed on an outer circumferential surface (or a groove in an upper surface, which communicates with the outer circumferential surface) of the frame 21 and an outer circumferential surface of the first scroll 32, respectively, into the lower space 10*c* for collection.

In addition, oil that, along with the refrigerant, is discharged from the compression chamber V to the upper space 10*b* in the casing 10 is separated from the refrigerant in the upper space 10*b* in the casing 10, and then flows along the first oil flow passage PO1, which is formed in an outer circumferential surface of the electric motor 20, and the second oil flow passage PO2, which is formed in an outer circumferential surface of the compression unit 30, into the lower space 10*c* for collection. The flow passage separation unit 40, which will be described below, is provided between the electric motor 20 and the compression unit 30. Thus, the oil, which is separated from the refrigerant in the upper space 10*b* and flows into the lower space 10*c*, interferes with and is mixed again with the refrigerant that is discharged in the compression unit 20 and flows into the upper space 10*b*. The oil and the refrigerant flow along paths PO1 and PO2 and the paths PG1 and PG2, which are different from each other, into the lower space 10*c* and the upper space 10*b*, respectively.

On the other hand, a compression chamber oil-supply path F2 for supplying the oil that flows along the oil supply flow passage 50*a* and then is absorbed upward, to the compression chamber V is formed in the second scroll 33. The compression chamber oil-supply path F2 is connected to the sliding member oil supply path F1, which is described above.

The compression chamber oil-supply path F2 is configured to include a communicating first oil supply flow path 371 that connects between the oil supply flow passage 50*a* and the second backpressure chamber S2 that serves as the intermediate pressure space, and a second oil supply flow path 372 that communicates with the intermediate pressure chamber of the compression chamber V.

Of course, the directly-communicating compression chamber oil-supply path F2 may be formed to connect between the oil supply flow passage 50*a* and the intermediate pressure chamber without the second backpressure chamber S2 being involved. However, in this case, a communicating refrigerant flow passage needs to be separately provided between the second backpressure chamber S2 and the intermediate pressure chamber V, and an oil flow passage for supplying oil to the oldham ring 35 that is positioned in the second backpressure chamber S2 needs to be separately provided. This increases the number of paths and makes processing complex. Therefore, at least to unify the refrigerant flow passage and the oil flow passage and thus to decrease the number of paths, as in the present embodiment, it is desirable that the oil supply flow passage 50*a* and the second backpressure chamber S2 communicates with each other and that the second backpressure chamber S2 communicates with the intermediate pressure chamber V.

To do this, the first oil supply path 371 includes a first orbiting path portion 371*a* that is formed in the lower surface of the second disc portion 331 to run up to the middle in the thickness direction, a second orbiting path portion 371*b* that is formed to extend from the first orbiting path portion 371*a* toward an outer circumferential surface of the second disc portion 331, and third orbiting path portion 371*c* to pass through toward the upper surface of the second disc portion 331, which is formed to extend from the second orbiting path portion 371*b*.

Then, the first orbiting path portion 371*a* is formed in a position in which the first backpressure chamber S1 is positioned, and the third orbiting path portion 371*c* is formed in a position in which the second backpressure chamber S2 is positioned. Then, a pressure reducing bar 375 is inserted into the second orbiting path portion 371*b* in such a manner that pressure of oil that flows from the first backpressure chamber S1 to the second backpressure chamber S2 along the first oil supply path 371 is reduced. Accordingly, a cross-sectional area of the second orbiting path portion 371*b* except for the pressure reducing bar 375 is smaller than that of the first orbiting path portion 371*a* or the third orbiting path portion 371*c*.

At this point, in a case where an end portion of the third orbiting path portion 371*c* is formed in such a manner that the end portion is positioned inward than the oldham ring 35, that is, is positioned between the oldham ring 35 and the sealing member 36, oil that flows along the first oil supply path 371 is blocked by the oldham ring 35 and thus does not flow smoothly to the second backpressure chamber S2. Therefore, in this case, a fourth orbiting path portion 371*d* is formed to extend from an end portion of the third orbiting path portion 371*c* toward the outer circumferential surface of the second disc portion 331. The fourth orbiting path portion 371*d*, as illustrated in FIG. 4, may be formed to be a groove in an upper surface of the second disc portion 331, and may be formed to be a hole in the inside of the second disc portion 331.

The second oil supply path 372 includes a first stationary path portion 372*a* that is formed in an upper surface of the second side-wall portion 322 in the thickness direction, a second stationary path portion 372*b* that is formed to extend from the first stationary path portion 372*a* in the radial direction, and third stationary path portion 372*c* that is formed to extend from the second stationary path portion 372*b* and to communicate with the intermediate pressure chamber V.

A reference numeral 70 in the drawing, which is not described, indicates an accumulator.

The lower compression type of scroll compressor according to the present embodiment, which is described above, operates as follows.

That is, when the electric motor 20 is powered on, rotary power occurs to the rotor 22 and the rotation shaft 50, and the rotor 22 and the rotation shaft 50 rotate. As the rotation shaft 50 rotates, with the Oldham ring 35, the orbiting scroll 33 that is eccentrically combined with the rotation shaft 50 performs the orbiting motion.

Then, a refrigerant that is supplied from outside of the casing 10 through the refrigerant absorption pipe 15 is introduced into the compression chamber V. This refrigerant is compressed as the volume of the compression chamber V decreases by the orbiting motion of the orbiting scroll 33. The compressed refrigerant is discharged into the internal space in the discharge cover 34 through the discharge outlets 325*a* and 325*b*.

Then, the refrigerant that is discharged into the internal space in the discharge cover 34 circulates in the internal space in the discharge cover 34. After noise decreases, the refrigerant flows into a space between the frame 31 and the stator 21, and flows into an upper space over the electric motor 20 through a space between the stator 21 and the rotor 22.

Then, the refrigerant that results from separating the oil from the refrigerant in the upper space over the electric motor 20 is discharged to outside of the casing 10 through the refrigerant discharge pipe 16, and on the other hand, the oil flows into the lower space 10*c* that is the oil storage space in the casing 10 through a passage between the inner circumferential surface of the casing 10 and the stator 21 and a passage between the inner circumferential surface of the casing 10 and the outer circumferential surface of the compression unit 30. A sequence of these processes is repeated.

At this time, the oil in the lower space 10*c* is absorbed upward flowing along the oil supply flow passage 50*a* in the rotation shaft 50, and the first bearing unit 51 and the second bearing unit 52, and the eccentricity portion 53 are lubricated with the oil that flows along the oil supply holes 511, 521, and 531 and the oil supply grooves 512, 522, and 532, respectively.

The oil that flows along the first oil supply hole 511 and the first oil supply groove 512, with which the first bearing unit 51 is lubricated, collects in the first connection groove 541 between the first bearing unit 51 and the eccentricity portion 53 and is introduced into the first backpressure chamber S1. The oil generates almost discharge pressure and thus pressure in the first backpressure chamber S1 is increased to the discharge pressure. Therefore, the center portion side of the second scroll 33 is supported, in the axial direction, by the discharge pressure.

On the other hand, the oil in the first backpressure chamber S1 flows into the second backpressure chamber S2 along the first oil supply path 371 due to a pressure difference with the second backpressure chamber S2. At this time, the pressure reducing bar 375 is provided in the second orbiting path portion 371*b* that serves as the first oil supply path 371, and thus pressure of the oil that flows toward the second backpressure chamber S2 is reduced.

Then, the oil that flows into the second backpressure chamber (the intermediate pressure space) S2 supports an edge portion of the second scroll 33, and at the same time, flows into the intermediate pressure chamber V along the second oil supply path 372 due to a pressure difference with the intermediate pressure chamber V. However, when pressure in the intermediate pressure chamber V is higher than pressure in the second backpressure chamber S2 during the operation of the compressor, the refrigerant flows from the intermediate pressure chamber V toward the second backpressure chamber S2 along the second oil supply path 372. In other words, the second oil supply path 372 plays the role of a passage along which the refrigerant and the oil flow in opposite directions due to the pressure difference between the second backpressure chamber S2 and the intermediate pressure chamber V.

On the other hand, as described above, the oil separation unit 40 is installed in the intermediate space (hereinafter referred to as a first space) 10*a* that is a passing-through space which is formed between a lower surface of the electric motor 20 and an upper surface of the compression unit 30. The oil separation unit 40 plays the role of preventing the refrigerant that is discharged from the compression unit 30 from interfering with the oil that flows from the upper space (hereinafter referred to as a second space) 10*b* in the electric motor 20, which is the oil separation space, into a lower space (hereinafter referred to as a third space) 10*c* in the compression unit 30 that is the oil storage space.

To do this, the flow passage separation unit 40 according to the present embodiment includes a passage guide that separates the first space 10*a* into a space (hereinafter referred to as a refrigerant flow space) in which the refrigerant flows, and a space (hereinafter referred to as an oil flow space) in which the oil flows. Only with the passage guide itself, the first space 10*a* is separated into the refrigerant flow space and the oil flow space, but whenever necessary, a combination of multiple passage guides may play the role of the passage guide. In the present embodiment, as a typical example, the latter is first described, and then the former will be described in detail below.

Figure 5:
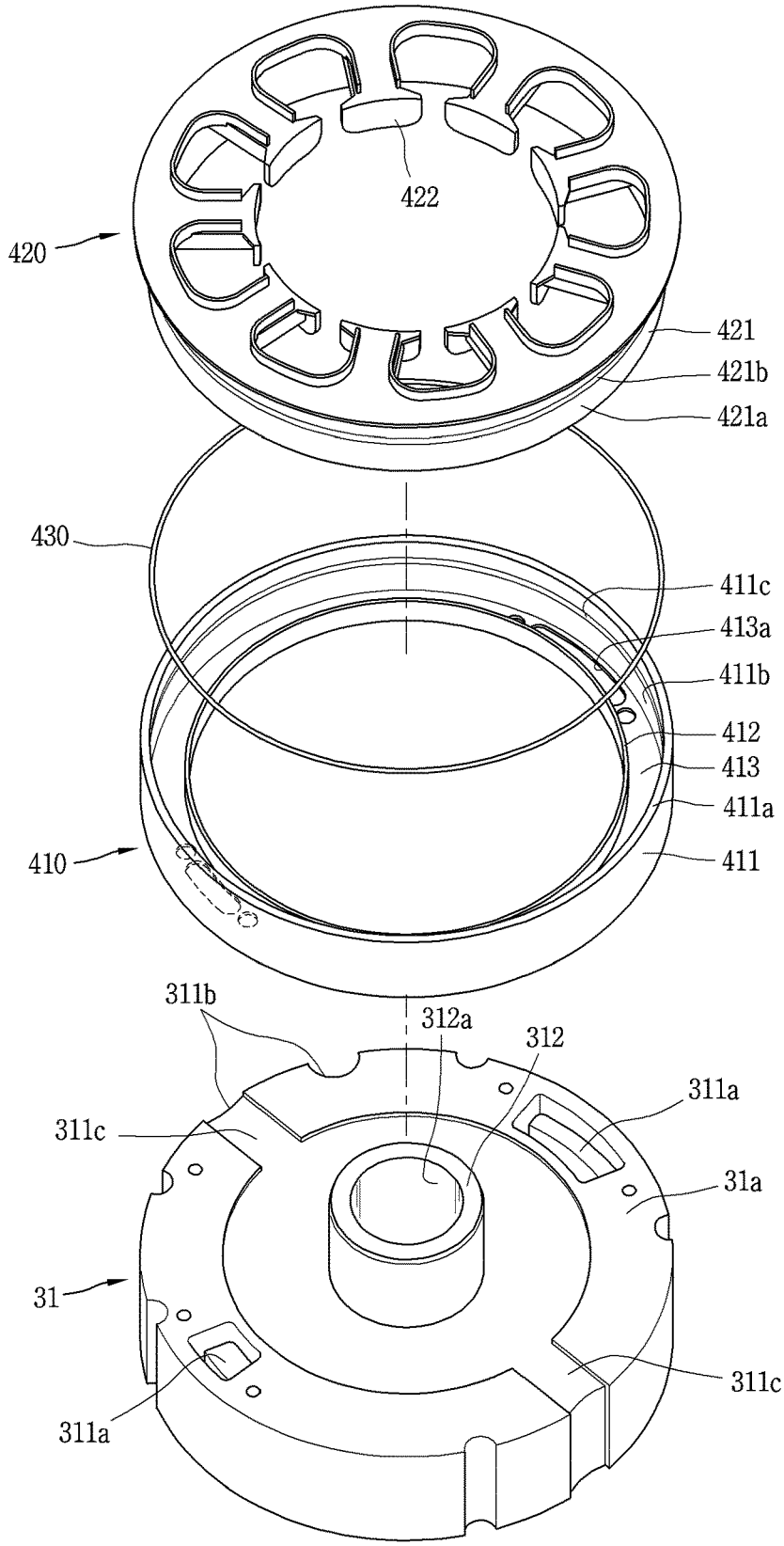
FIG. 5 is an exploded perspective diagram illustrating a flow passage separation unit in the scroll compressor in FIG. 1.
Figure 6:
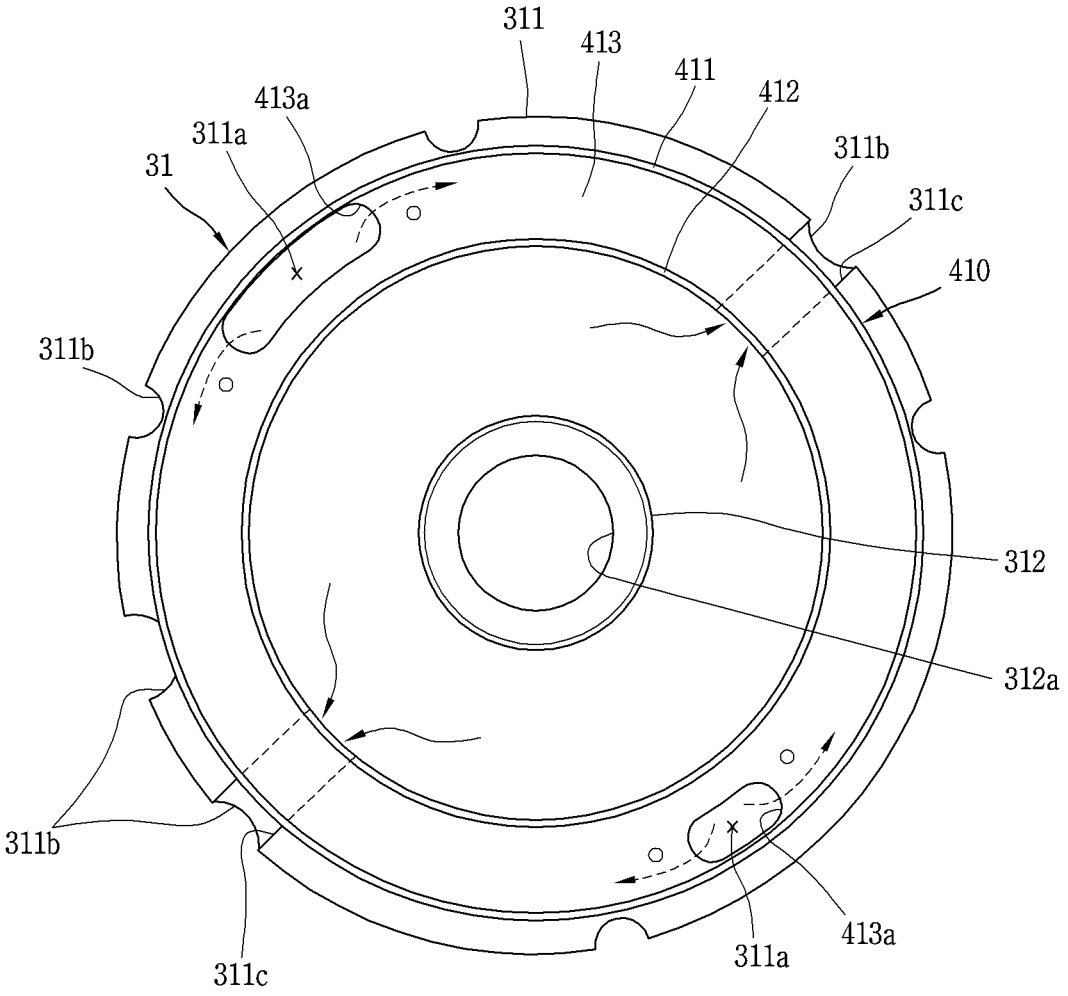
FIG. 6 is a plan-view diagram illustrating a first flow passage guide in the flow passage separation unit in FIG. 5, when viewed from above.
Figure 7:
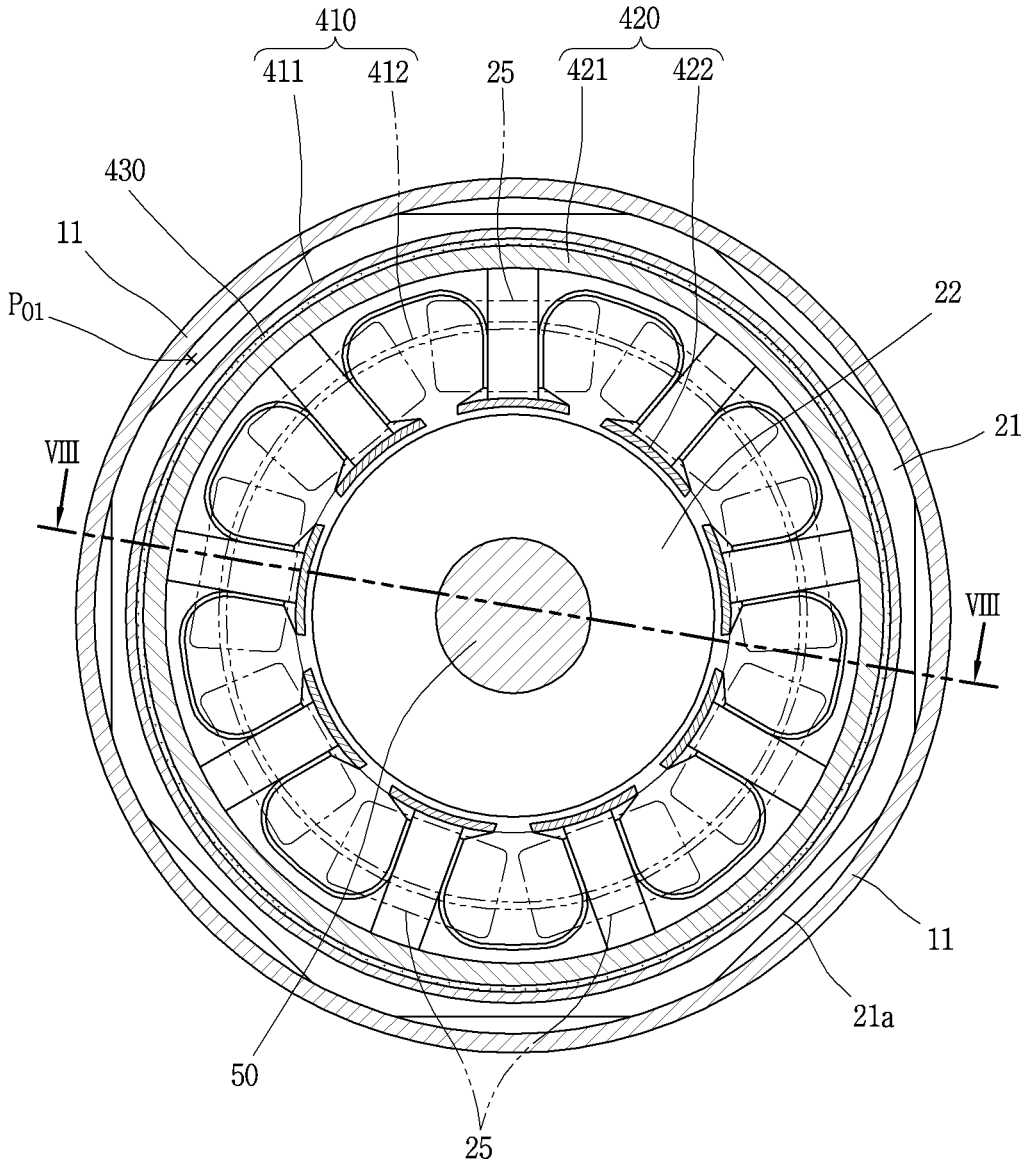
FIG. 7 is a plan-view diagram illustrating the first flow passage guide and a second flow passage guide in the flow passage separation unit in FIG. 5, when viewed from below.
Figure 8:
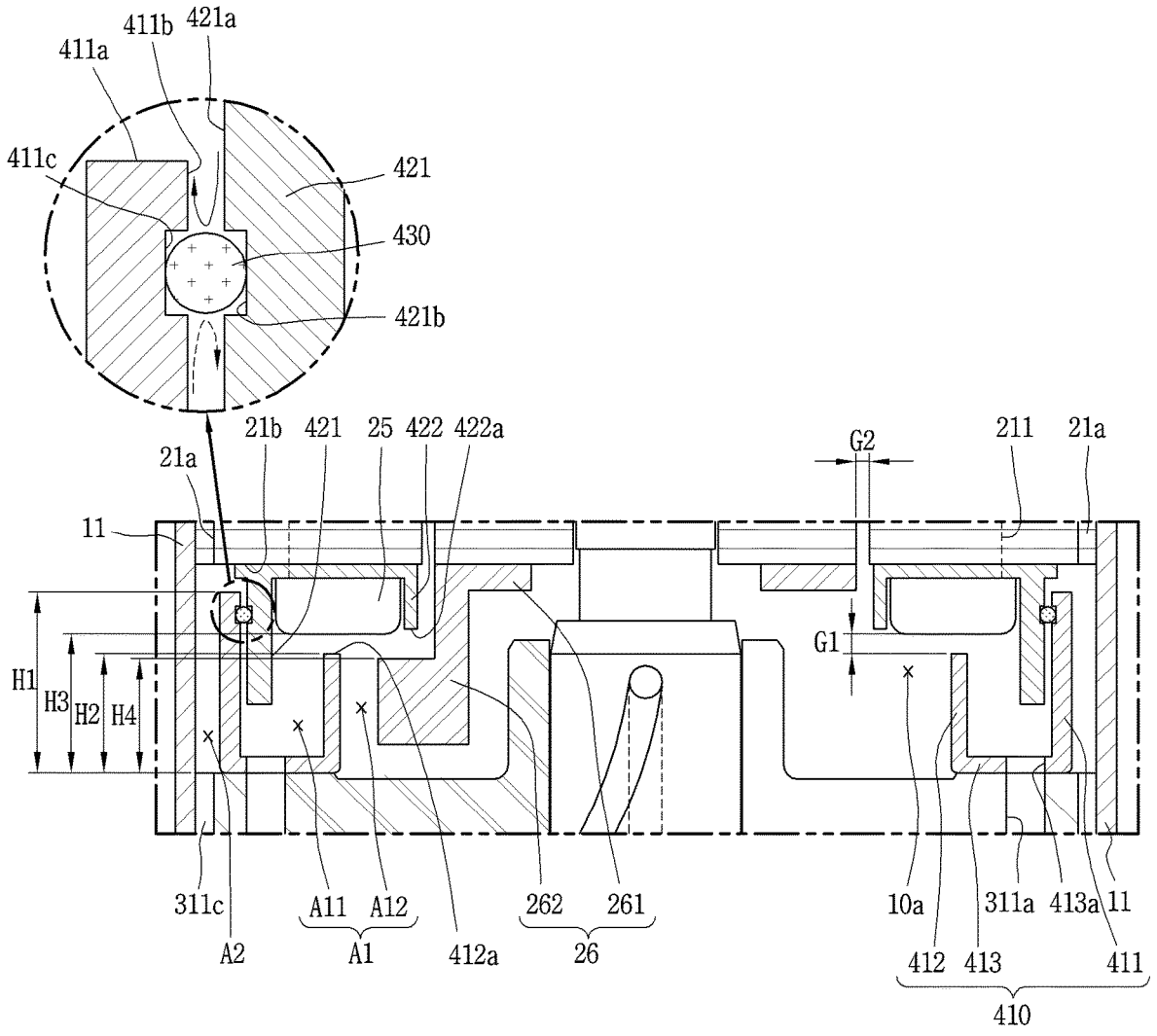
FIG. 8 is a cross-sectional diagram illustrating an assembled state of that the flow passage separation unit, taken along line VIII-VIII in FIG. 7.

FIGS. 5 to 7 are diagrams illustrating a state where the passage separation unit according to the present embodiment is dismantled or assembled. FIG. 8 is a vertical cross-sectional diagram illustrating a state where the passage separation unit which is illustrated in FIG. 5 is assembled. FIGS. 9A to 10E are magnified cross-sectional diagrams of a portion of the passage separation unit for describing passage separation units according to embodiments.

As illustrated in FIGS. 5 to 7, a first flow passage guide 410 that is formed in the shape of a ring is fixedly combined with the upper surface 31*a* of the frame 31. The first flow passage guide 410, along with a second flow passage guide 420 that extends from the stator 21, makes up the flow passage separation unit. The first flow passage guide 410 that is manufactured in the shape of a ring is fixedly combined with the upper surface 31*a* of the frame 31. The second flow passage guide 420 is formed to extend from an insulator that is inserted into the stator 21 and insulates a winding coil. Alternatively, the second flow passage guide 420 is separately manufactured and is combined with the stator 21. As an example, the second flow passage guide that extends from the insulator will be described below.

Multiple second refrigerant holes 311*a* that, along with a first refrigerant hole (which has no reference numeral) in the first scroll 32, makes up the first refrigerant flow passage PG1, are formed in the axial direction in the frame 31 in such a manner as to pass through the frame 31. On one side of the second refrigerant hole 311*a*, an oil collection groove 311*c* is formed in the radial direction in the upper surface 31*a* of the frame 31.

The oil collection groove 311*c* is connected to the communicating groove 311*b* in the first side-wall portion 311. Thus, the oil that is separated from the refrigerant on the upper surface 31 as of the frame 31 is introduced into the second oil flow passage PO2 along the oil collection groove 311*c*, and flows into the lower space 10*c*, along with the oil that flows along the first oil flow passage PO1 and collects.

At this point, the oil collection groove 311*c* that is formed in the upper surface 31*a* of the frame 31 serves as a communicating path between the refrigerant flow space and the oil flow space that make up the first space. However, an annular surface portion 413 of the first flow passage guide 410, which will be described below, covers the oil collection groove 311*c* and thus a state where the refrigerant flow space and the oil flow space communicate with each other is reduced to a minimum. Moreover, in the present embodiment, a first oil supply groove 512 is formed to have a structure in which an upper end of the first oil supply groove 512 is blocked in the bearing unit 51, and thus an amount of oil that flows over the first shaft bearing unit 312 and flows on the upper surface 31*a* of the frame 31 is very small. Because of this, a very small cross-sectional area of the oil collection groove 311*c* can be formed. Therefore, a situation where the refrigerant in the refrigerant flow space passes through the oil collection groove 311*c* and flows into the oil flow space seldom occurs.

On the other hand, the first flow passage guide 410 includes first annular wall portion 411 that separates the refrigerant flow passage and the oil flow passage in the first space 10*a*. Thus, an intermediate space 10*a* is separated by the first annular wall portion 411 into a refrigerant flow space A1 and an oil flow space A2. The refrigerant that is discharged into the upper space 10*b* flows along the refrigerant flow passages PG1 and PG2, and the oil that collects into the lower space 10*c* flows along the oil flow passages PO1 and PO2.

Furthermore, the first flow passage guide 410 further includes a second annular wall portion 412, in addition to the first annular wall portion 411. The second annular wall portion 412 is formed more inward than the first annular wall portion 411, that is, is formed to the side of the rotation shaft 50, and separates the refrigerant flow space A1 into a first refrigerant flow space A11 and a second refrigerant flow space A12.

At this point, the first annular wall portion 411 and the second annular wall portion 412 may be formed independently of each other. In this case, any one of the first annular wall portion 411 and the second annular wall portion 412 may be integrally combined with the upper surface 31*a* of the frame 31 using a molding or processing method, or both of the first annular wall portion 411 and the second annular wall portion 412 may be integrally combined with the upper surface 31*a* of the frame 31 using a molding or processing method.

However, with the annular surface portion 413, the first annular wall portion 411 and the second annular wall portion 412 are connected to each other. Thus, the first flow passage guide 410 that includes the first annular wall portion 411 and the second annular wall portion 412 can be manufactured as a single product. Thus, not only is a manufacturing processing simplified, but an assembling process is also easily performed. In this case, a refrigerant through-hole 413*a* is formed in the annular surface portion 413 to pass through the annular surface portion 413 in the axial direction, and the refrigerant through-hole 413*a* communicates with a second refrigerant hole 311*a* that makes up the first refrigerant flow passage PG1.

In the present embodiment, as a typical example, an example in which a first annular wall portion and a second annular wall portion are integrally combined with an annular surface portion is described. Another example in which the second annular wall portion of the first annular wall portion and the second annular wall portion will be described below. An example in which each of the first annular wall portion and the second annular wall portions is integrally combined with the frame is apparent from the embodiments described above, and thus is not separately described.

As illustrated in FIGS. 6 and 7, the first annular wall portion 411 is formed in the shape of a ring. A lower end in the axial direction, of the first annular wall portion 411 sits on the upper surface 31*a* of the frame 31 for support, and on the other hand, an upper end in the axial direction, of the first annular wall portion 411 is formed in such a manner as to be close to the lower surface 21*b* of the stator 21. Thus, the first annular wall portion 411 is formed in the shape of a cylinder with a prescribed height.

In addition, it is desirable that the first annular wall portion 411 is positioned between the outer circumferential surface of the stator 21 and an external flank surface of the coil winding portion, more precisely, between the D-cut surface 21*a* of the stator 21 and an external end 212*a* of the slot 211 that makes up the coil winding portion. Thus, the first annular wall portion 411 is positioned more outward than an external extension (hereinafter referred to as a first extension portion) of the second flow passage guide 420, which will be described above. Therefore, when a sealing member 430, which will be described below, is provided between the first annular wall portion 411 and the first extension portion 421, ideally, the refrigerant in the refrigerant flow space A1 does not flow into the flow space A2, and the oil that flows into the oil flow space A2 and collects does not flow into the refrigerant flow space A1.

At this point, the second flow passage guide 420 is formed to extend from the insulator that is inserted into the slot 211 of the stator 21 and plays the role of insulating the stator 21 from a winding coil 25. Normally, the second flow passage guide 420 includes the first extension portion 421 and an external extension portion (hereinafter referred to as a second extension portion) 422, which extend more downward than a winding body of the winding coil 25, from both the ends, the upper end and the lower end, respectively, of the stator 21.

Then, the first extension portion 421 is formed in the shape of a ring or is formed in the shape of multiple protrusions, but as in the present embodiment, it is desirable that the first extension portion 421 is formed in the shape of a ring in order to play the role of separating the first space 10*a* along with the first annular wall portion 411.

As illustrated in FIG. 8, instead of an upper end in the axial direction, of the first annular wall portion 411 being positioned a fixed distance away from the lower surface 21*b* of the stator 21, the sealing member 430 is provided between an inner circumferential surface 411*a* of the first annular wall portion 411 and a member that comes into contact with the inner circumferential surface 411*a*, that is, an outer circumferential surface 421*a* of the external extension portion 421 of the second flow passage guide 420. Thus, the refrigerant flow space A1 that is an internal space of the first annular wall portion 411 and the oil flow space A2 that is an external space of the first annular wall portion 411 are reliably separated by the first annular wall portion 411, the first extension portion 421, and the sealing member 430.

Then, sealing grooves 411*c* and 421*b* may be formed in any one of the inner circumferential surface 411*b* of the first annular wall portion 411 and the outer circumferential surface 421*a* of the first extension portion, and the sealing member 430 in the shape of a ring may be inserted into the sealing grooves 411*c* and 421*b* for combination. However, the first annular wall portion 411 of the first flow passage guide 410 and the first extension portion 421 of the second flow passage guide 420 cannot be thickened due to a spatial restriction. Therefore, as illustrated in FIG. 8, the sealing grooves 411*c* and 421*b* are formed on the inner circumferential surface 411*b* of the first annular wall portion 411 and the outer circumferential surface 421*a* of the first extension portion 421, respectively. Halves of the sealing member 430 are inserted into both the sealing grooves 411*c* and 421*c*, respectively.

As illustrated in FIGS. 6 and 7, like the first annular wall portion 411, the second annular wall portion 412 is formed to have a prescribed height. A lower end in the axial direction, of the second annular wall portion 412 sits on the upper surface 31*a* of the frame 31, and on the other hand, an upper end 412*a* in the axial direction, of the second annular wall portion 412 is formed to extend toward the stator 21 in such a manner that the upper end 412*a* is positioned a fixed distance away from the lower surface 21*b* of the stator 21.

However, it is desirable that the second annular wall portion 412 is formed in such a manner that a height H2 of the second annular wall portion 412 is lower than a height H1 of the first annular wall portion 411. The reason for this is as follows. When the height H 2 of the second annular wall portion 412 is so high that contact with the lower surface 21*b* of the stator 21 takes place, or when a distance G2 is too short, a gap G2 between the stator 21 and the rotor 22 is an obstacle to the flow of the refrigerant because most of the refrigerant that is discharged inward from the first annular wall portion 411 along the first refrigerant flow passage PG1 flows into the second space 10*b* only along the slot 211.

Therefore, it is desirable that the second annular wall portion 412 of the first flow passage guide 410 is positioned more outward than a second extension unit 422 of the second flow passage guide 420, and that the second annular wall portion 412 is formed in such a manner that a height H2 of the second annular wall portion 412 is smaller than a height H1 of the first annular wall portion 411 and is smaller than a height H3 of the second extension portion 422 of the second flow passage guide 420 from the lower surface 21*b* of the stator 21, more precisely, the upper surface 31*a* of the frame 31.

Furthermore, the second annular wall portion 412 has a balance weight 26 inside, and thus it is desirable that a position and a height are set considering tracks of the balance weight 26. That is, the second annular wall portion 412 is provided to prevent the refrigerant, which is discharged into the first space 10*a* along the first refrigerant flow passage PG1, from being agitated due to the balance weight 26 that rotates. In this respect, it is desirable that the second annular wall portion 412 is formed to be positioned outside of the tracks of the balance weight 26 and to have a height that is equal to or greater than a height H4 of an eccentricity mass portion 262 of the balance weight 26. The height H4 is set to be lower than a lower end of the winding coil 25 in order to prevent the balance weight 26 from colliding with the winding coil 25. In this respect, as described above, it is desirable that the second annular wall portion 412 is formed to be positioned more outward than the second extension unit 422, but more inward than the first extension portion 421 in such a manner that the height H2 of the second annular wall portion 412 is smaller than that of the winding coil 25 and is smaller than that of a lower end 422*a* of the second extension portion 422 of the second flow passage guide 420.

At this point, the balance weight 26 may be combined with the rotation shaft 50, but, in the present embodiment, is fixedly combined with a lower end of the rotor 22 and thus rotates along with the rotor 22.

That is, the balance weight 26 is configured to include a stationary portion 261 that is combined with the rotor 22, and an eccentricity mass portion 262 that extends eccentrically in the radial direction from the stationary portion 261. Therefore, the eccentricity mass portion 262 extends more outward than the rotor 22. Thus, the eccentricity mass portion 262 extends out of the gap G2 between the stator 21 and the rotor 22. Because of this, the second annular wall portion 412 is positioned at least out of the gap G2 between the stator 21 and the rotor 22. Thus, in a case where the second annular wall portion 412 is formed to too high a height and thus the distance G to the winding coil 25 is decreased or the upper end 412*a* of the second annular wall portion 412 is bent in a rotary axial direction, the refrigerant that is discharged into the first space 10*a* is not guided into the gap G2 between the stator 21 and the rotor 22, thereby increasing flow passage resistance. Therefore, it is desirable that the height H2 of the second annular wall portion 412 is not smaller than a height H4 of an upper surface of the balance weight 26, but the distance G1 to the winding coil 25 is greatly increased. Of course, a protrusion length of the second extension unit 422 from the lower surface 21*b* of the stator 21 is equal to or smaller than a protrusion length of the wing coil 25.

On the other hand, a position in which the sealing member is installed in the flow passage separation unit according to the present embodiment is changed in various ways.

Figure 9A:
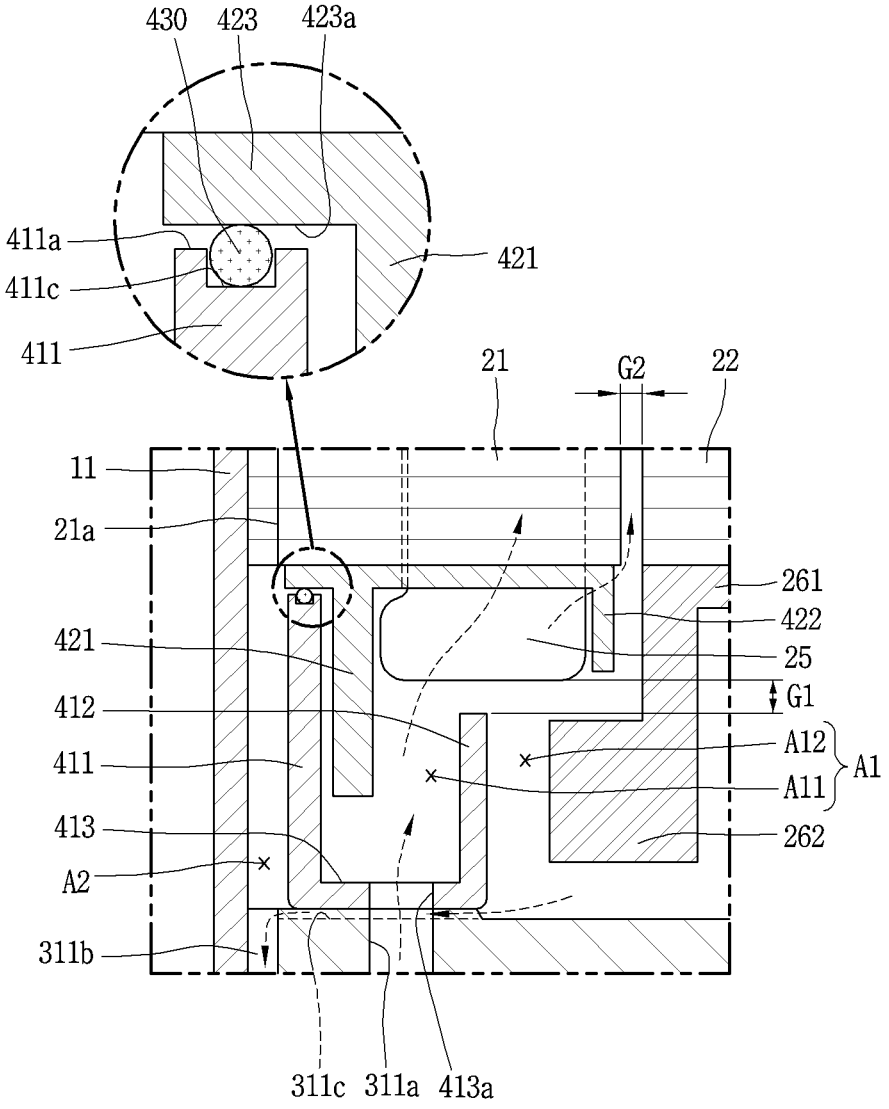
FIGS. 9A to 10E are enlarged cross-sectional diagrams of portions of flow passage separation units according to embodiments for describing the flow passage separation units.

For example, as illustrated in FIG. 9A, the sealing member may be installed between an upper end surface 411*a* of the first annular wall portion 411 and the lower surface 21*b* of the stator 21, or a lower surface 423*a* of the plane portion 423 of the second flow passage guide 420 that extends outward in the radial direction of the first extension portion 421. Even in this case, a sealing groove 411*c* into which the sealing member 430 is inserted is formed in the upper end surface 411*a* of the first annular wall portion 411. Of course, the halves of the sealing groove may be formed in the upper end surface 411*a* of the first annular wall portion 411 and the lower surface 21*b* of the stator 21 (or the lower surface 423*a* of the plane portion 423 of the second flow passage guide 420), respectively.

As described above, even in a case where the sealing member 430 is installed between the upper end surface 411*a* of the first annular wall portion 411 and the lower surface 21*b* of the stator 21 (or the lower surface 423*a* of the plane portion 423 of the second flow passage guide 420), basic configuration of the first annular wall portion and the second annular wall portion, and the second flow passage guide that corresponds to the first annular wall portion and the second annular wall portion, and effects that results from the basic configurations are similar to those in the embodiments described above. However, in the present embodiment, not only is the staying of the oil between the first annular wall portion 411 and the first extension portion 421 minimized, but the oil is also prevented from being introduced inward from the first annular wall portion 411 due to a machine error or vibration.

Furthermore, the first flow passage guide that makes up the flow passage separation unit may be integrally combined with the frame in a manner that extends from the frame, and at the same time, may be formed to be combined with the extension portion of the second flow passage guide, without being separately manufactured and assembled.

Figure 9B:
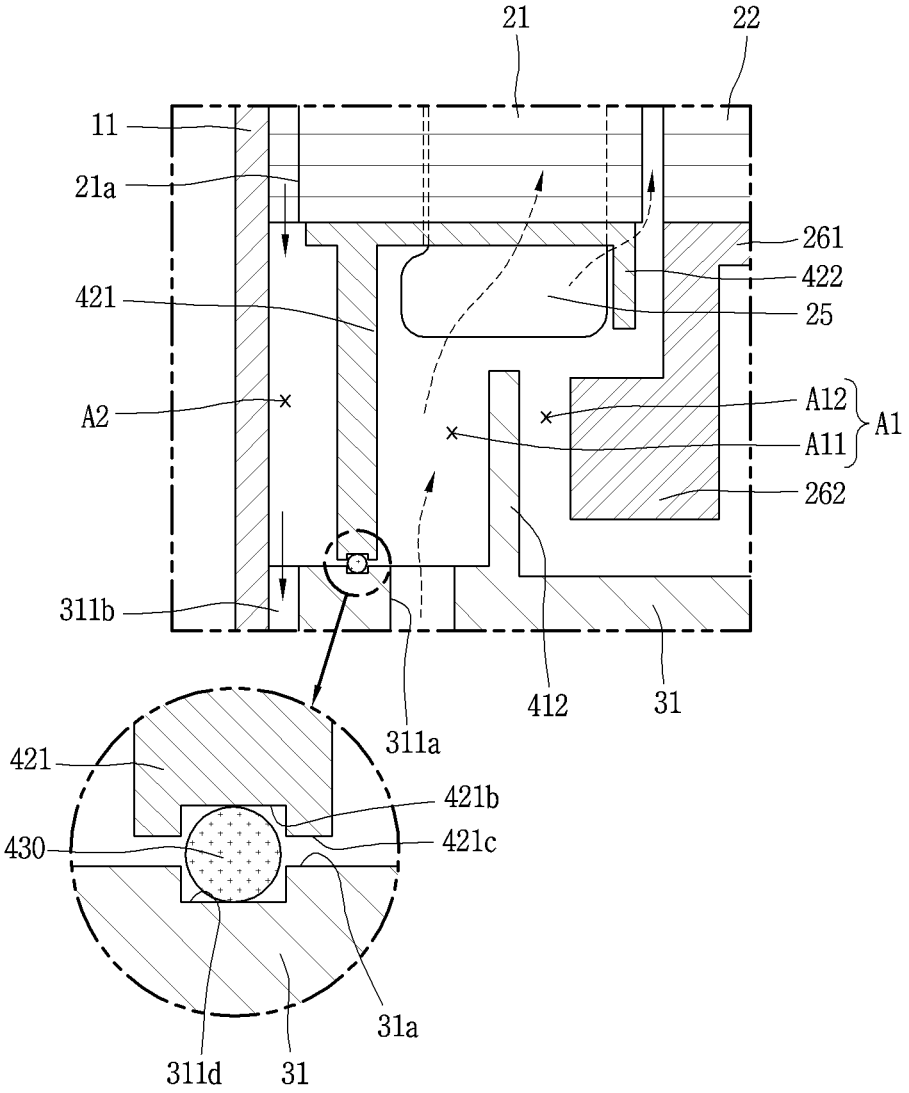

For example, as illustrated in FIG. 9B, the second annular wall portion 412 is formed to extend from the upper surface 31*a* of the frame 21, and the first extension portion 421 of the second flow passage guide 420 is formed to have a long length. The sealing member may be installed between a lower end surface 421 of the first extension portion 421 and the upper surface 31*a* of the frame 31 with which the lower end surface 421*c* of the first extension portion 421 comes into contact. In this case, sealing grooves 421 and 311*d* in which the sealing member 430 is inserted are formed in the lower end surface 421*c* of the first extension portion 421 and the upper surface 31*a* of the frame 31, respectively. Of course, the sealing groove may be formed in any one of the lower end surface 421*c* of the first extension portion 421 and the upper surface 31*a* of the frame 31.

As described above, even in a case where the sealing member 430 is installed between the lower end surface 421*c* of the first extension portion 421 and the upper surface 31*a* of the frame 31, basic configurations of the second extension portion 422 including the first extension portion 421, and the second annular wall portion 412 and effects that results from the basic configurations are similar to those in the embodiments described above. However, in the present embodiment, not only does the first extension portion 421 play the role of the first annular wall portion 411 concurrently, but the second annular wall portion 412 is also integrally combined with the frame 31 in a manner that extends from the frame 31. As a result, flow resistance of the refrigerant is reduced. Furthermore, a structure of the flow passage separation unit is simplified thereby saving a manufacturing cost.

On the other hand, in addition to the flow passage separation unit according to the present embodiment, a flow passage separation unit according to another embodiment is as follows.

That is, in the embodiment described above, a separate sealing member is used to provide tight sealing between the first flow passage guide and the second flow passage guide, but in the present embodiment, only with the first flow passage guide or the second flow passage guide, the refrigerant flow passage and the oil passage flow passage are tightly separated.

Figure 10A:
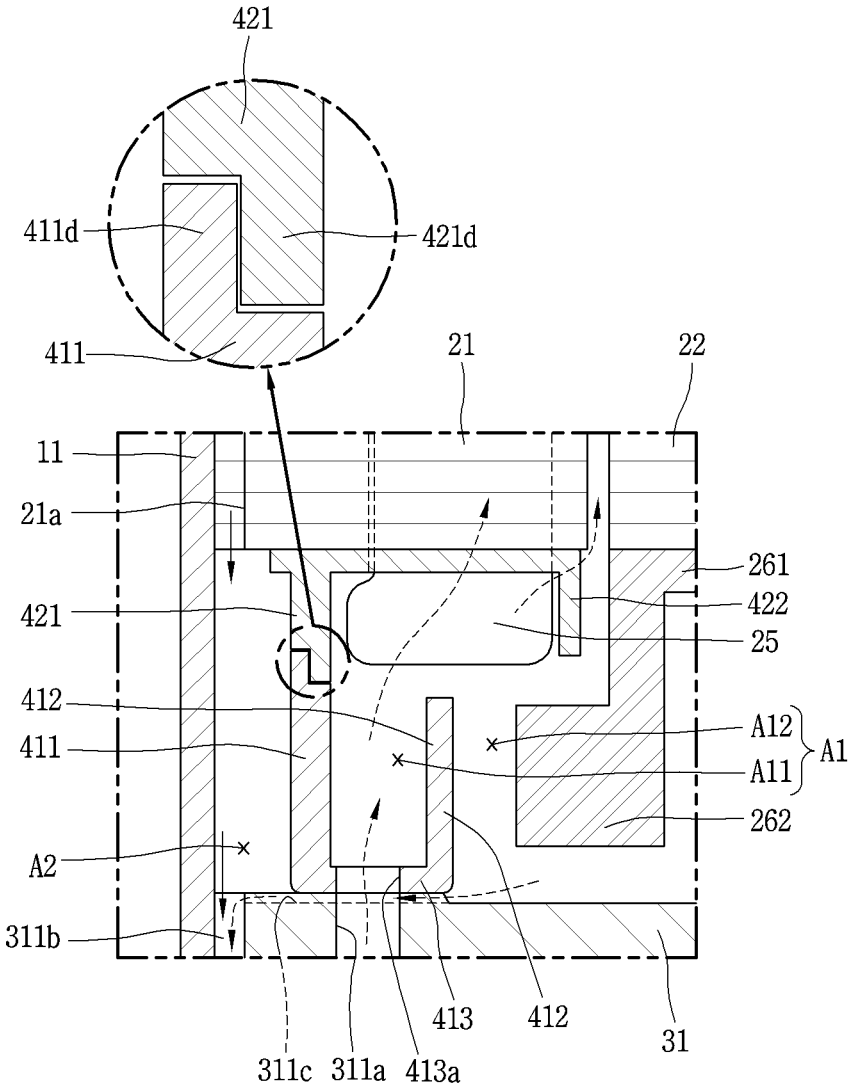
Figure 10B:
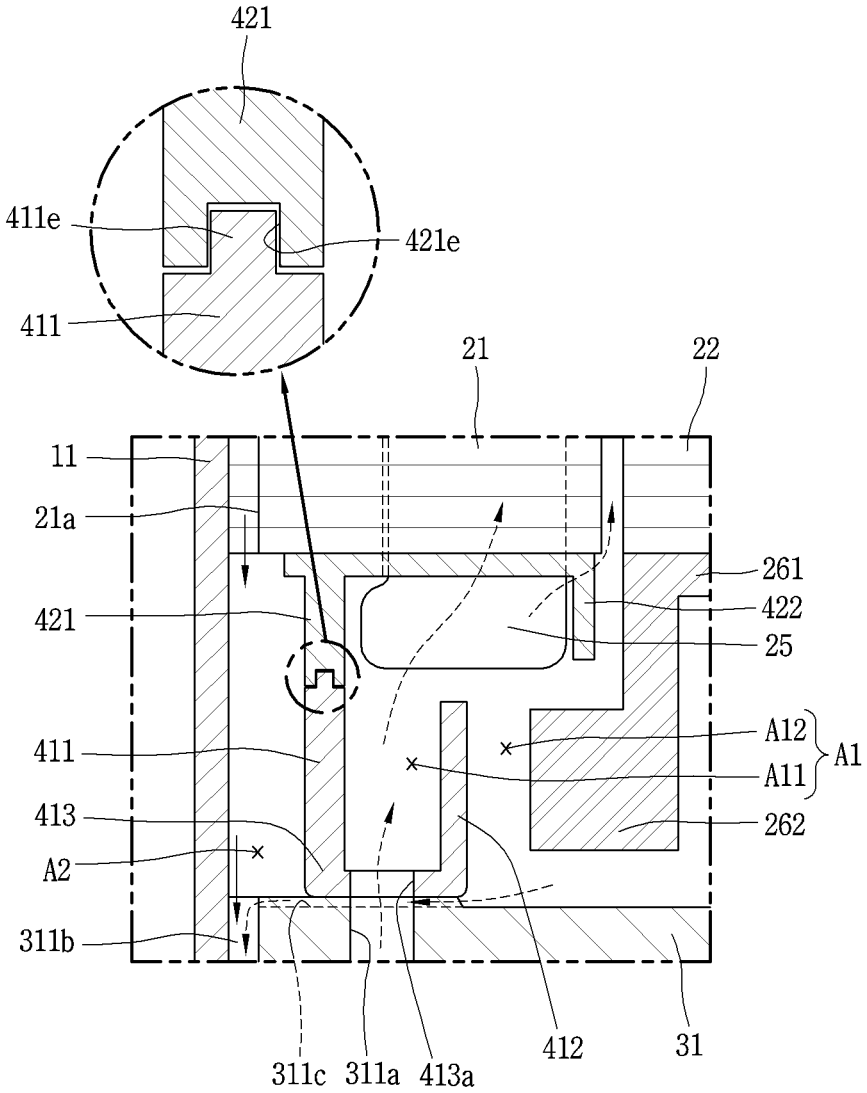

For example, as illustrated in FIG. 10A, stepped portions 411*d* and 421*d* may be formed on the upper end surface 411*a* of the first annular wall portion 411 and the lower end surface 421*c* of the first extension portion 421, prospectively, and may be combined with each other in a stair-stepped manner. Alternatively, as illustrated in FIG. 10B, the upper end surface 411*a* and the lower end surface 421*c* may be combined with each other in a manner that engages a protrusion 411*e* and a groove 421*e* with each other. When this is done, a sealing area between the upper end surface 411*a* of the first annular wall portion 411 and the lower end surface 421*c* of the first extension portion 421 is increased and thus both the paths are tightly separated.

Figure 10C:
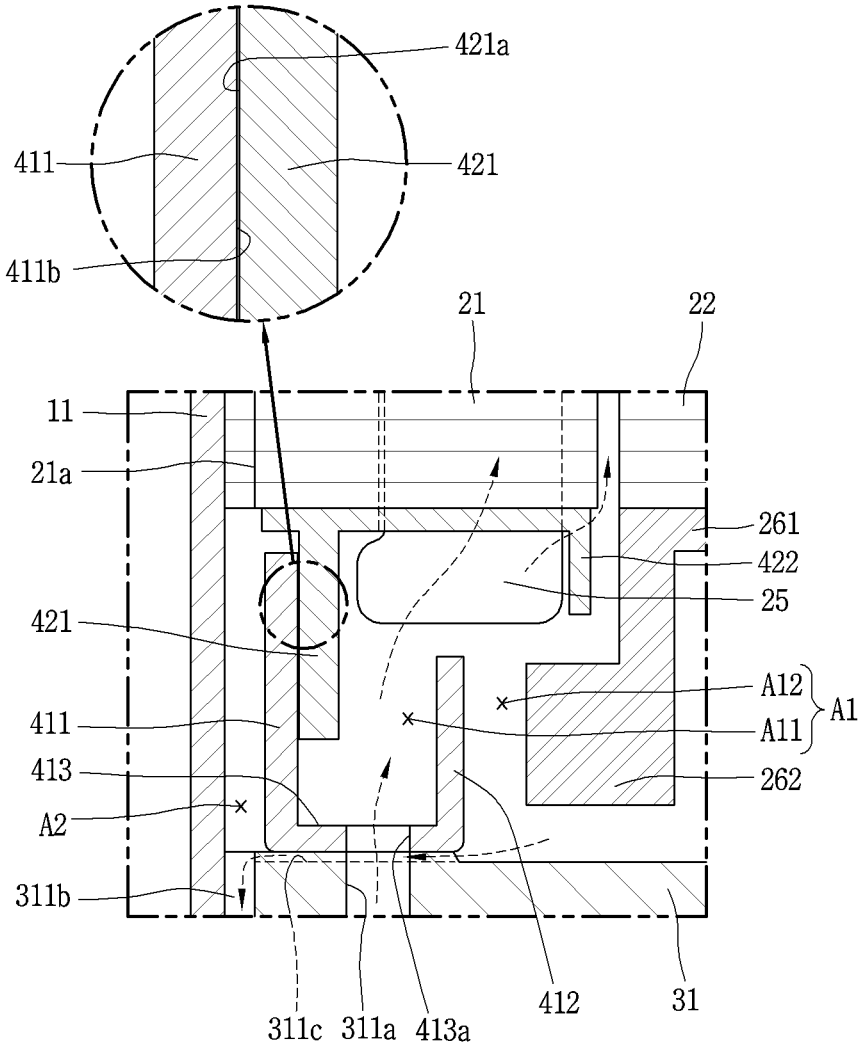

Furthermore, as illustrated in FIG. 10C, the inner circumferential surface 411*b* of the first annular wall portion 411 and the outer circumferential surface 421*a* of the first extension portion 421 may be formed in a position where interference with each other takes place. Thus, the inner circumferential surface 411*b* of the first annular wall portion 411 and the outer circumferential surface 421*a* of the first extension portion 421 are forcefully brought into contact tightly with each other and thus both the paths can be tightly separated.

Figure 10D:
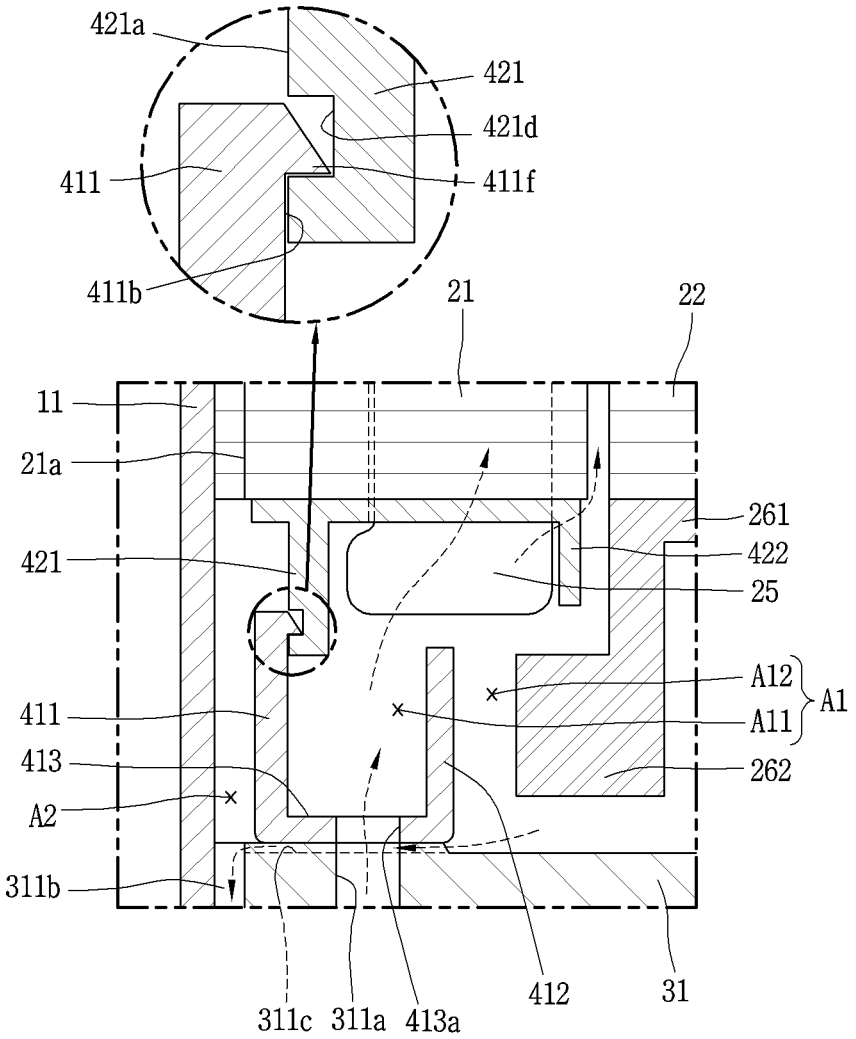

Furthermore, as illustrated in FIG. 10D, a hook protrusion 411*f* and a hook groove 421*d* may be formed on the inner circumferential surface 411*b* of the first annular wall portion 411 and the outer circumferential surface 421*a* of the first extension portion 421, respectively, and may be combined with each other in a hooked manner. Thus, the inner circumferential surface 411*b* of the first annular wall portion 411 and the outer circumferential surface 421*a* of the first extension portion 421 are combined each other and thus both the paths can be separated more tightly.

Figure 10E:
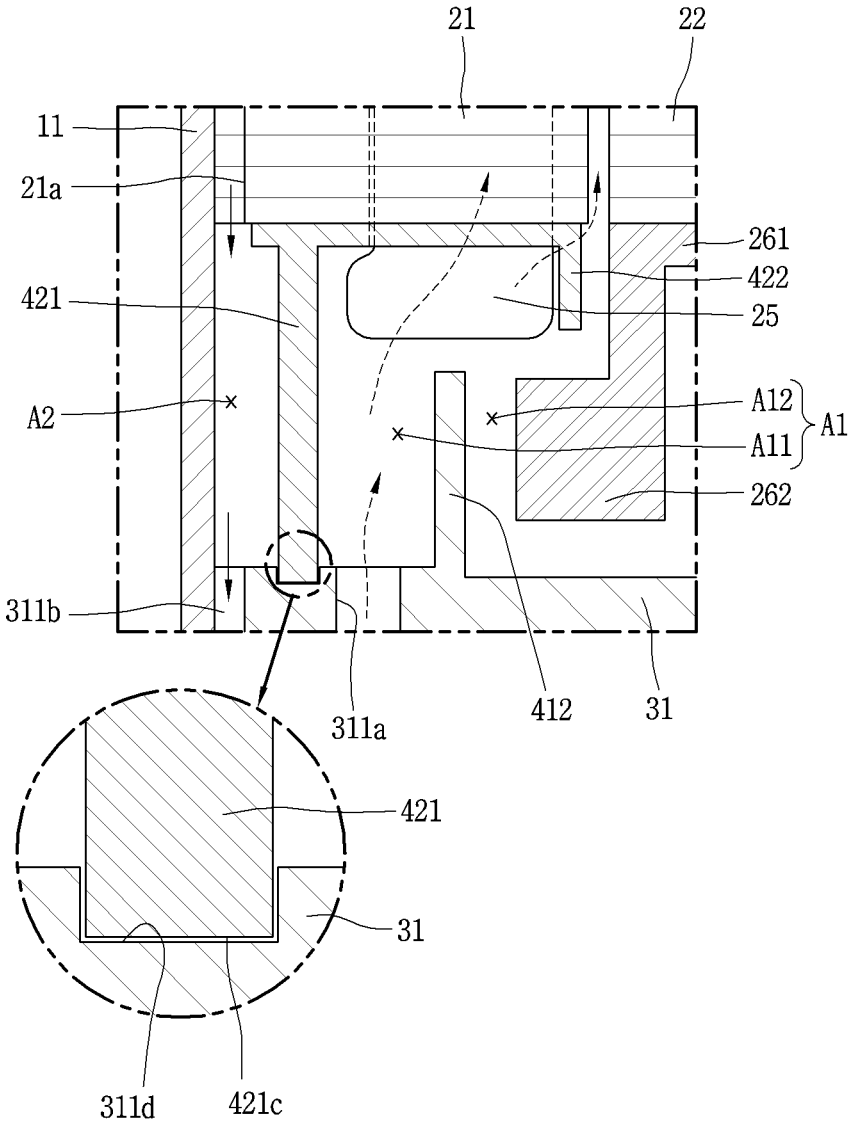

Furthermore, as illustrated in FIG. 10E, the first extension portion 421 further extends without separately manufacturing and assembling the first flow passage guide, and thus a lower end 421*c* of the first extension portion 421 is inserted into a sealing groove 311*d* that is provided in the upper surface 31*a* of the frame 31. Thus, both the paths can be more tightly. In this case, the first extension portion 421 described above extends to take place of the first annular wall portion, and on the other hand, the second annular wall portion 412 is formed to be integrally combined with the fame 31 in such a manner as to extend from the upper surface 31*a* of the frame 31. Furthermore, although not illustrated in the drawings, the first annular wall portion 411 may extend so much that the first annular wall portion is inserted into a lower surface of the second flow passage guide 420.

The flow of the refrigerant and the oil in the scroll compressor according to the present invention is described as follows.

Figure 11:
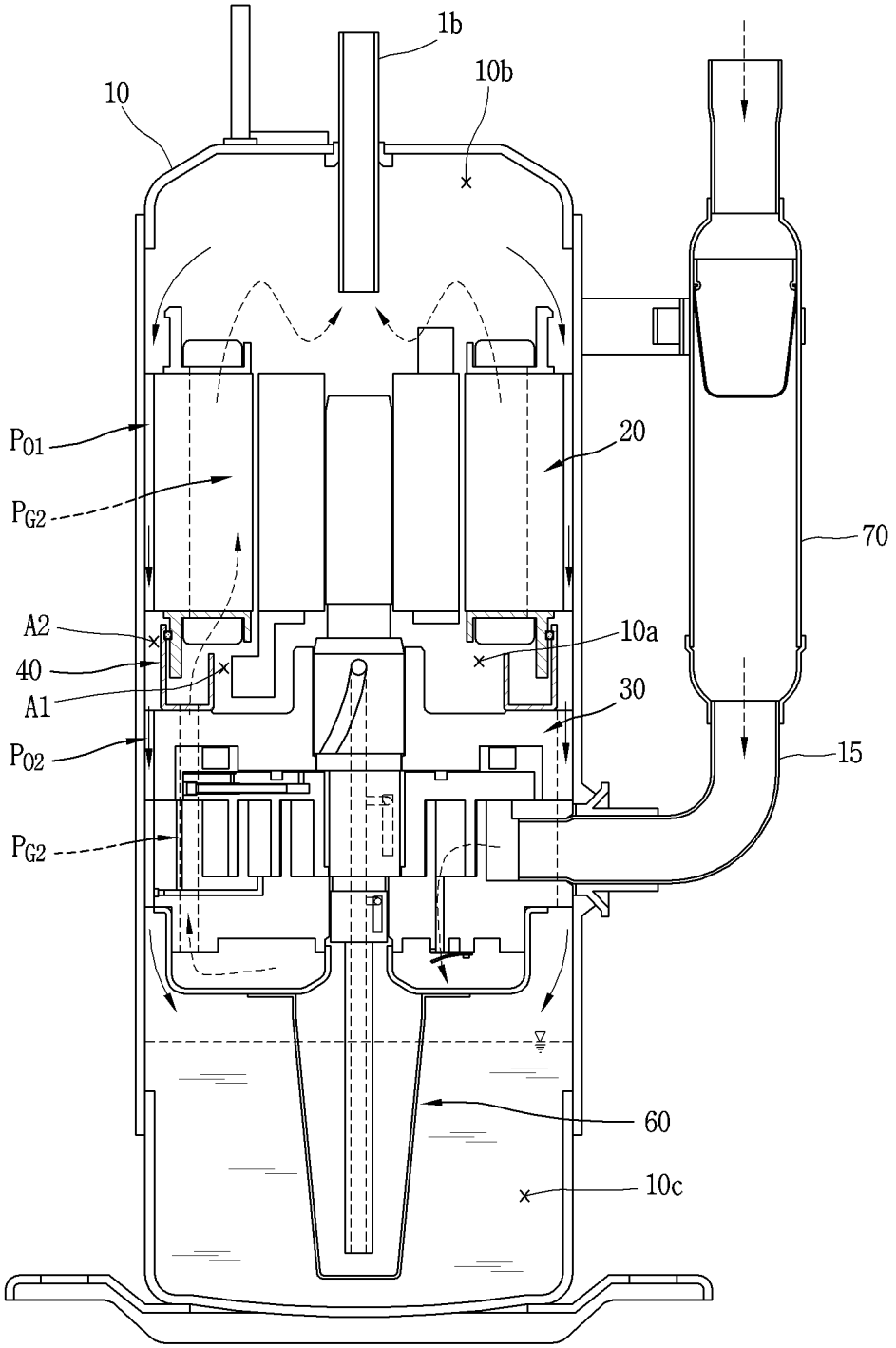
FIG. 11 is a schematic diagram for describing flows of refrigerant and oil that is separated from the refrigerant in the scroll compressor in FIG. 1.

That is, as illustrated in FIG. 11, the internal space in the case 10 is divided into three spaces, that is, a first space 10*a* between the lower surface of the electric motor 20 and the upper surface of the compression unit 30, a second space 10*b* that is a space over the electric motor 20, and a third space 10*c* that is a space under the compression unit 30, which serves as a free space.

Then, the first space 10*a* is further divided by the flow passage separation unit 40 into the internal refrigerant flow space A1 and the external oil flow space A2. The refrigerant flow space A1 communicates with the first refrigerant flow passage PG1 and the second refrigerant flow passage PG2. The oil flow space A2 communicates the first oil flow passage PO1 and the second oil flow passage PO2.

Thus, the refrigerant (indicated by a dotted-line arrow) that is discharged from the compression unit 30 into the internal space in the discharge cover 34 flows into the refrigerant flow space A1 of the first space 10*a* along the first refrigerant flow passage PG1. Then, the refrigerant flows by the flow passage separation unit 40 into the second space 10*b* along the second refrigerant flow passage PG2. At this time, the second annular wall portion 412 of the first flow passage guide 410 that makes up the oil separation unit 40 is further divided into the first refrigerant flow space A11 and the second refrigerant flow space A12, and thus the refrigerant is prevented from being introduced into a space the falls within a rotation shaft range of the balance weight 26. Thus, the balance weight 26 is prevented in advance from agitating the refrigerant.

On the other hand, the oil is included in the refrigerant that flows into the second space 10*b* is separated from the refrigerant while the refrigerant circulates in the second space 10*b*. The refrigerant from which the oil is separated is discharged to the outside of the compressor through the refrigerant discharge pipe 16, and on the other hand, the oil that is separated from the refrigerant (indicated by a solid-line arrow) flows down along the first oil flow passage PO1 that is formed in the outer circumferential surface of the stator 21.

Then, the oil that flows down along the first oil flow passage PO1 does not flow by the flow passage separation unit 40 from the first space 10*a* into the internal space. Instead, the oil, as is, flows into the third space 10*c* along the second oil flow passage PO2 and collects. Thus, the oil that is separated in the second space 10*b* that is the oil separation space quickly flows into the third space 10*c* that is the oil storage space. Thus, an oil shortage in the compressor can be prevented in advance. Particularly, the sealing member 430 is provided on the oil separation unit 40, or the sealing area is enlarged. As a result, the internal space and the external space in the first space 10*a* are tightly separated. Thus, the refrigerant that is discharged into the first space 10*a* is suppressed from being introducing into the oil flow passages PO1 and PO2, thereby increasing the oil collection effect.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A scroll compressor comprising:

a casing;

a drive motor located within the casing, the drive motor having a first flow passage and a second flow passage extending in an axial direction of the drive motor;

a rotation shaft connected to the drive motor, the rotation shaft having an eccentric portion;

a frame located below the drive motor, the frame configured to receive the rotation shaft to support the rotation shaft, the shaft extending through the frame;

a first scroll located below the frame, the first scroll having a first wrap;

a second scroll located between the frame and the first scroll, the second scroll having a second wrap configured to engage the first wrap, the second scroll being connected to the eccentric portion of the rotation shaft; and a ring shaped flow passage separation unit dividing a space between the drive motor and the frame into an internal space that communicates with the first flow passage of the drive motor and an external space that communicates with the second flow passage of the drive motor, wherein the flow passage separation unit includes:

a flow passage guide separating the internal space and the external space, the flow passage guide protruding from at least one of a lower surface of the drive motor and an upper surface of the frame toward the other one of the lower surface of the drive motor and the upper surface of the frame; and a sealing member contacting the flow passage guide, wherein the flow passage guide includes:

a first flow passage guide protruding from the upper surface of the frame toward the lower surface of the drive motor; and a second flow passage guide protruding from the lower surface of the drive motor toward the upper surface of the frame, wherein the first flow passage guide and the second flow passage guide overlap in the axial direction, wherein the sealing member is located between opposite surfaces of the first flow passage guide and the second flow passage guide, and wherein the sealing member is separate from the first flow passage and the second flow passage.

2. A scroll compressor comprising:

a casing having an inner circumferential surface;

a stator fixed within the casing, the stator having an outer circumferential surface having one or more first gaps located a distance away from the inner circumferential surface of the casing, and the stator having an inner circumferential surface defining a coil winding portion;

a winding coil wound around the coil winding portion;

a rotor spaced from the inner circumferential surface of the stator by a second gap;

a rotation shaft connected to the rotor, the rotation shaft having an eccentric portion;

a frame located below the stator, the frame configured to receive the rotation shaft to support the rotation shaft, the shaft extending through the frame;

a first scroll located below the frame, the first scroll having a first wrap;

a second scroll located between the frame and the first scroll, the second scroll having a second wrap configured to engage the first wrap, the second scroll being connected to the eccentric portion of the rotation shaft;

a flow passage guide extending in an axial direction of the rotation shaft from an upper surface of the frame or a lower surface of the stator facing the upper surface of the frame, the flow passage guide separating the second gap from the one or more first gaps, the flow passage guide including:

a ring shaped first annular wall portion having a first height in the axial direction, the first annular wall portion being located between the coil winding portion and the one or more first gaps; and a ring shaped second annular wall portion having a second height in the axial direction, the second annular wall portion being located between the second gap and the coil winding portion; and a member extending from the other of the upper surface of the frame or the lower surface of the stator from which the flow passage guide extends, wherein the first annular wall portion faces the member, wherein the scroll compressor further comprises a sealing member located between the first annular wall portion and the member, and wherein the sealing member is separate from the first annular wall portion and the member.

3. The scroll compressor of claim 2, wherein the first height is greater than or equal to the second height.

4. The scroll compressor of claim 3, further comprising a balance weight located on the rotor or the rotation shaft, the balance weight being located inward from the second annular wall portion.

5. The scroll compressor of claim 3, wherein an end portion of the second annular wall portion is located a further distance away from the member in the axial direction than from an end portion of the first annular wall portion in the axial direction.

* * * * *